US009760049B2

(12) United States Patent
Kadowaki et al.

(10) Patent No.: US 9,760,049 B2
(45) **Date of Patent: *Sep. 12, 2017**

(54) FIXING APPARATUS

(71) Applicant: CANON KABUSHIKI KAISHA, Tokyo (JP)

(72) Inventors: Hiroyuki Kadowaki, Yokohama (JP); Atsushi Iwasaki, Susono (JP); Daizo Fukuzawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/151,923

(22) Filed: May 11, 2016

(65) Prior Publication Data

US 2016/0252860 A1 Sep. 1, 2016

Related U.S. Application Data

(62) Division of application No. 14/883,709, filed on Oct. 15, 2015, now Pat. No. 9,372,456.

(30) Foreign Application Priority Data

Oct. 21, 2014 (JP) ..... 2014-214795

(51) Int. Cl.
*G03G 15/20* (2006.01)

(52) U.S. Cl.
CPC ..... *G03G 15/2089* (2013.01); *G03G 15/2053* (2013.01); *G03G 2215/0132* (2013.01); *G03G 2215/2035* (2013.01); *G03G 2215/2058* (2013.01); *G03G 2215/2061* (2013.01); *G03G 2215/2064* (2013.01)

(58) Field of Classification Search
CPC ..... G03G 15/2053; G03G 15/2089; G03G 2215/2058; G03G 2215/2061; G03G 2215/2064
See application file for complete search history.

(56) References Cited

U.S. PATENT DOCUMENTS 6,775,509 B2 8/2004 Shida et al.
7,193,181 B2 3/2007 Makihira et al.
7,242,895 B2 7/2007 Inada et al.
(Continued)

FOREIGN PATENT DOCUMENTS

JP 10-198200 A 7/1998
JP 2003/228246 A 8/2003
(Continued)

*Primary Examiner* — Rodney Bonnette
(74) *Attorney, Agent, or Firm* — Fitzpatrick, Cella, Harper & Scinto

(57) ABSTRACT

A fixing apparatus a tubular film, a nip forming member that contacts an inner surface of the film, and a roller that forms a nip portion together with the nip forming member via the film. The nip portion is an area where the film and the roller are in contact with each other and where a recording material is conveyed. The nip forming member has a protruding portion, protruding toward the roller and extending in a generatrix direction, that is provided on at least one of an upstream side and a downstream side in the nip in a conveying direction of the recording material. In the conveying direction of the recording material, an end portion of the protruding portion in the generatrix direction is arranged at a location different from a central portion of the protruding portion in the generatrix direction.

5 Claims, 28 Drawing Sheets

(56) References Cited

U.S. PATENT DOCUMENTS

| | | | |
|---|---|---|---|
| 7,283,145 | B2 | 10/2007 | Kato et al. |
| 7,305,208 | B2 | 12/2007 | Inoue et al. |
| 7,366,455 | B2 | 4/2008 | Iwasaki et al. |
| 7,469,120 | B2 | 12/2008 | Iwasaki et al. |
| 7,630,662 | B2 | 12/2009 | Namiki et al. |
| 7,974,563 | B2 | 7/2011 | Sakai et al. |
| 8,005,413 | B2 | 8/2011 | Sakakibara et al. |
| 8,224,223 | B2 | 7/2012 | Sakakibara et al. |
| 8,331,819 | B2 | 12/2012 | Fukuzawa et al. |
| 8,369,763 | B2 | 2/2013 | Sakakibara et al. |
| 8,626,046 | B2 | 1/2014 | Sekihara et al. |
| 8,725,020 | B2 | 5/2014 | Fukuzawa et al. |
| 8,744,296 | B2 | 6/2014 | Fukuzawa et al. |
| 8,918,001 | B2 | 12/2014 | Kurata et al. |
| 9,116,480 | B2 | 8/2015 | Kadowaki et al. |
| 2003/0156866 | A1 | 8/2003 | Shida et al. |
| 2009/0116886 | A1 | 5/2009 | Sakai et al. |
| 2013/0195494 | A1 | 8/2013 | Asami et al. |
| 2013/0330103 | A1 | 12/2013 | Takahashi |
| 2014/0093268 | A1 | 4/2014 | Iwasaki et al. |
| 2015/0055968 | A1 | 2/2015 | Kadowaki |
| 2015/0309454 | A1 | 10/2015 | Kadowaki et al. |

FOREIGN PATENT DOCUMENTS

| | | | |
|---|---|---|---|
| JP | 2005-050693 | A | 2/2005 |
| JP | 2006-058527 | A | 3/2006 |
| JP | 2011-033671 | A | 2/2011 |

PRESSURE DISTRIBUTION IN CONVENTIONAL EXAMPLE

PRESSURE DISTRIBUTION IN EMBODIMENT 1

PRESSURE DISTRIBUTION IN PROTRUDING PORTION IN LONGITUDINAL DIRECTION IN CONVENTIONAL EXAMPLE AND IN EMBODIMENT 1

PRESSURE DISTRIBUTION IN CONVENTIONAL EXAMPLE 2

PRESSURE DISTRIBUTION IN EMBODIMENT 6

PRESSURE DISTRIBUTION IN PROTRUDING PORTION IN LONGITUDINAL DIRECTION IN CONVENTIONAL EXAMPLE 2 AND IN EMBODIMENT 6

FIXING APPARATUS

This application is a Divisional Application of U.S. patent application Ser. No. 14/883,709, filed on Oct. 15, 2015, allowed on Feb. 10, 2016, which claims the benefit of Japanese Patent Application No. 2014-214795, filed Oct. 21, 2014, which are both hereby incorporated by reference herein in their entireties.

BACKGROUND OF THE INVENTION

Field of the Invention

The present invention relates to a fixing apparatus mounted in an image-forming apparatus.

Description of the Related Art

As a fixing apparatus mounted in an image-forming apparatus such as a copier and a laser beam printer, a fixing apparatus using a film is known. This fixing apparatus generally has a tubular film, a nip forming member that comes into contact with an inner surface of the tubular film, and a pressuring roller that forms a nip together with the nip forming member via a film. The fixing apparatus heats and fixes a toner image to a recording material while conveying the recording material through the nip.

Japanese Patent Application Laid-open No. H10-198200 discloses a fixing apparatus including a support member with a protruding portion extending in a longitudinal direction and protruding toward the pressuring roller to serve as a nip forming member. The protruding portion causes a portion of the nip to be locally highly pressured to enable an increase in a gloss value for a toner image fixed to glossy paper or the like. The protruding portion extends in the longitudinal direction, and the position of the protruding portion in a conveying direction of the recording material is at a given distance from the center of the nip in the conveying direction of the recording material.

On the other hand, an apparatus is known in which the width of the nip in the conveying direction of the recording material (hereinafter referred to as the width of the nip) varies in the longitudinal direction. By way of example, Japanese Patent Application Laid-open No. 2003-228246 discloses an apparatus in which the outer diameter of the pressuring roller increases gradually from a central portion toward ends of the pressuring roller in the longitudinal direction. When the fixing apparatus in which the width of the nip varies in the longitudinal direction is provided with the protruding portion described in Japanese Patent Application Laid-open No. H10-198200, the following problems result. The penetration level of the protruding portion into the pressuring roller is higher in an area corresponding to a relatively large nip width than in an area corresponding to a relatively small nip width. The difference in the penetration level of the protruding portion 1 corresponds to a difference in the pressure peak.

Thus, when the width of the nip is larger at ends of the pressuring roller than at a central portion thereof in the longitudinal direction, the pressure peak is higher at the ends than at the central portion. In contrast, when the width of the nip is larger at the central portion than at the ends, the pressure peak is higher at the central portion than at the ends.

When the pressure peak in the longitudinal direction varies, the gloss value for the toner image fixed on the recording material may vary. In an image, a large gloss value is achieved in an area where the toner image is fixed using a portion of the pressuring roller with a high pressure peak, whereas a small gloss value is achieved in an area where the toner image is fixed using a portion of the pressuring roller with a low pressure peak. This leads to uneven gloss. Such unevenness of the gloss value may be perceived as an image defect.

SUMMARY OF THE INVENTION

A preferred embodiment for carrying out the present invention is a fixing apparatus that fixes an image on a recording material, the fixing apparatus. The apparatus comprises: a tubular film; a nip forming member that contacts an inner surface of the film; and a roller that forms a nip portion together with the nip forming member via the film. The roller has a region where a diameter of the roller gradually increases in a direction from a central portion to each of end portions of the roller with respect to a generatrix direction of the film. The nip portion is an area where the film and the roller are in contact with each other and where the recording material is conveyed. The nip forming member has a protruding portion, protruding toward the roller and extending in the generatrix direction, that is provided on at least one of an upstream side and a downstream side in the nip portion in a conveying direction of the recording material. End portions of the protruding portion in the generatrix direction are positioned at a larger distance from a center of the nip portion in the conveying direction than a central portion of the protruding portion in the generatrix direction.

Further features of the present invention will become apparent from the following description of exemplary embodiments (with reference to the attached drawings).

DESCRIPTION OF THE EMBODIMENTS

With reference to the drawings, embodiments of the present invention will be illustratively described in detail based on examples. However, the dimensions, materials, shapes, relative arrangements, and the like of components described in the embodiments should be changed as needed according to the configuration of an apparatus to which the present invention is applied and various conditions. That is, the scope of the present invention is not intended to be limited to the embodiments described below.

(1) General Configuration of the Image-Forming Apparatus

Figure 1:
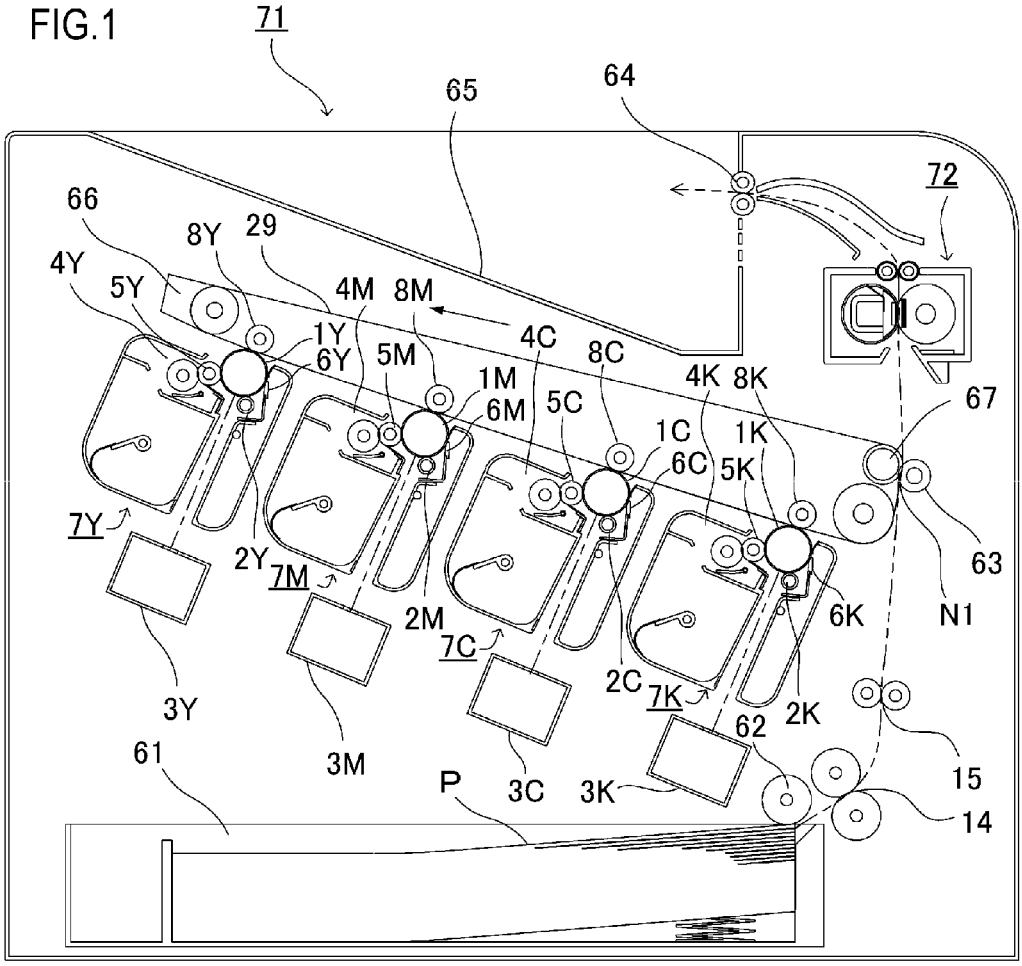
FIG. 1 is a schematic sectional view depicting a general configuration of an image-forming apparatus according embodiments of the present invention.

First, with reference to FIG. 1, a general configuration of an image-forming apparatus according to the embodiments of the present invention will be described. FIG. 1 is a schematic sectional view depicting a general configuration of the image-forming apparatus according to the embodiments of the present invention. An example of the image-forming apparatus will be described below using a full-color laser beam printer (hereinafter simply referred to as a printer) 71 including a plurality of photosensitive drums 1. However, the present invention is not limited to the full-color laser beam printer. A monochromatic copier or printer with one photosensitive drum may be used.

As depicted in FIG. 1, the printer 71 includes, as main components, image forming stations 7Y, 7M, 7C, and 7K corresponding to yellow Y, magenta M, cyan C, and black K, respectively, an intermediate transfer belt 29, a secondary transfer roller 63, and a fixing apparatus 72. Indices Y, M, C, and K added to reference numerals in order to indicate for which of the colors the corresponding element is provided are omitted when the distinction among the colors is not particularly needed.

A cassette 61 is housed in a lower portion of the printer 71 so as to be able to be withdrawn. Recording materials P, such as paper, are stacked and accommodated in the cassette 61. The recording materials P are fed from a sheet feeding cassette 61 by a pickup roller 62. Each of the recording materials P is separated from the others by a feed retard roller pair 14 and fed to a registration roller 15.

Each of the image forming stations 7 is provided with the photosensitive drum 1 serving as an image bearing member, a charging apparatus 2, a developing assembly 4, a cleaning blade 6, and a primary transfer section 8. The charging apparatus 2 uniformly charges a surface of the photosensitive drum 1. The developing assembly 4 has a developing roller 5 that attaches toner to an electrostatic latent image formed on the photosensitive drum 1 to form a toner image. The primary transfer section 8 primarily transfers the toner image formed on the photosensitive drum 1 onto the intermediate transfer belt 29. The cleaning blade 6 removes the toner remaining on the photosensitive drum 1 without being primarily transferred.

Moreover, below the image forming stations 7, laser scanners 3Y, 3M, 3C, and 3K are arranged to irradiate the charged photosensitive drums 1 with laser beams based on image information to form electrostatic latent images on the respective photosensitive drums 1. The toner image transferred onto the intermediate transfer belt 29 by the primary transfer section 8 is secondarily transferred to the recording material P by a secondary transfer section N1 provided by an opposite roller 67 and the secondary transfer roller 63. Secondary untransferred toner remaining on the intermediate transfer belt 29 without being transferred to the recording material P by the secondary transfer section N1 is removed and collected by a belt cleaning apparatus 66. The recording material P having passed through the secondary transfer section N1 subsequently passes through the fixing apparatus 72. The toner image is fixed onto the recording material P.

The recording material P with the toner image fixed thereto is subsequently conveyed to a discharge roller pair 64. After passing through the discharge roller pair 64, the recording material P is discharged into a recording material stacking section 65. The printer 71 in the present embodiments enables A3-sized recording materials to be fed. The maximum width of the recording material P that can be fed by the image-forming apparatus is 320 mm in a direction orthogonal to a conveying direction.

Embodiment 1

(2) Fixing Apparatus

Figure 2A:
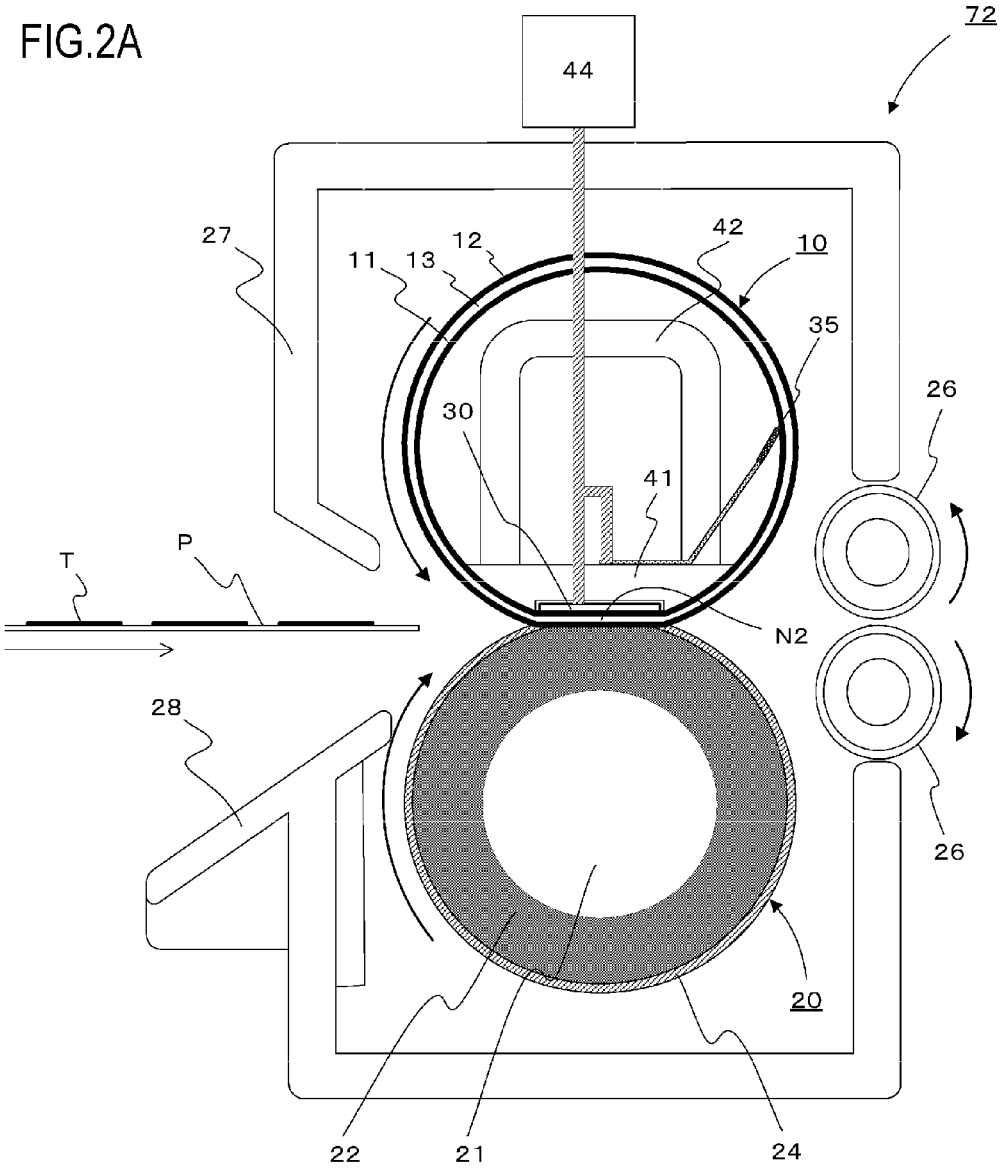
FIGS. 2A and 2B are diagrams depicting a fixing apparatus in Embodiment 1.
Figure 2B:
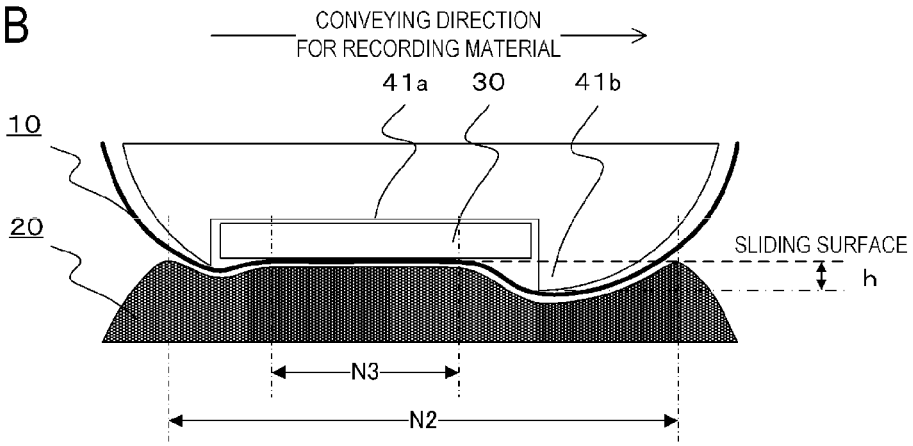
Figure 3:
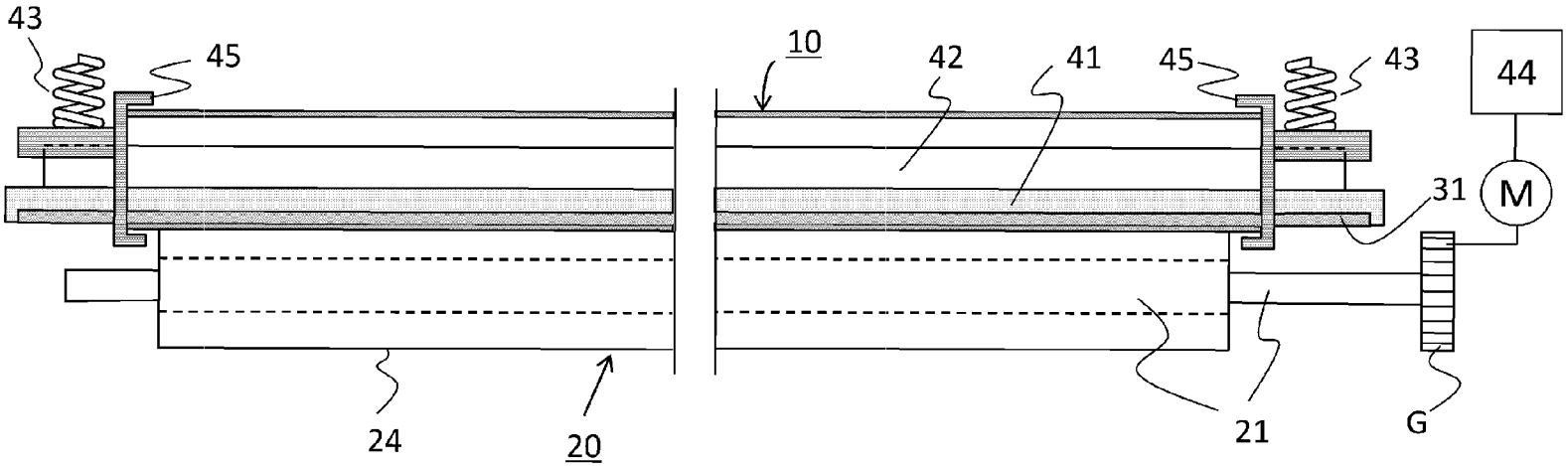
FIG. 3 is a schematic diagram depicting the fixing apparatus in Embodiment 1.

Now, the fixing apparatus in Embodiment 1 of the present invention will be described with reference to FIGS. 2A, 2B and 3. FIGS. 2A and 2B are diagrams depicting the fixing apparatus in Embodiment 1. FIG. 2A is a schematic sectional view, and FIG. 2B is an enlarged view of the neighborhood of a fixing nip in FIG. 2A. FIG. 3 is a schematic diagram of the fixing apparatus in Embodiment 1. In regard to the fixing apparatus 72 and members forming the fixing apparatus 72, a longitudinal direction as used herein refers to an axial direction of a pressuring roller 20, that is, a direction orthogonal to a conveying direction of the recording material P. In FIGS. 2A and 2B, the orientation of the fixing apparatus 72 corresponds to rotation of FIG. 1 through 90 degrees for convenience of description.

The fixing apparatus 72 in Embodiment 1 is a pressuring roller driven film heating-based apparatus having a fixing film 10 serving as a cylindrical, flexible film member and the pressuring roller 20 provided in pressure contact with the fixing film 10. The pressuring roller 20 is rotationally driven to drive the fixing film 10. At a fixing nip N2 formed by the fixing film 10 and the pressuring roller 20, a toner image on the recording material P is heated and fixed to the recording material P while the recording material P is conveyed in a sandwiching manner.

Furthermore, as depicted in FIGS. 2A, 2B, and 3, the fixing apparatus 72 has a heater 30 serving as a heating element, a heater holder 41, a pressuring stay 42 serving as a rigid pressuring member, pressuring means 43 serving as urging means for generating a pressuring force, and a fixing flange 45 serving as a regulating member. The heater 30, the fixing film 10, the heater holder 41, the pressuring stay 42, and the pressuring roller 20 are all elongate in the longitudinal direction. The fixing flange 45 regulates movement of the fixing film 10 in the longitudinal direction. The heater 30 and the heater holder 41 in Embodiment 1 are components corresponding to a contact member in the present invention and are provided in contact with an outer peripheral surface of the fixing film 10. The longitudinal direction of the fixing film 10 is a generatrix direction of the film 10.

2-1) Fixing Film

The fixing film 10 has a base layer 11 formed like an endless (tubular) film using a heat resistant and flexible material, and a release layer 12 provided on an outer peripheral surface of the base layer 11. For improved fixing performance, an elastic layer 13, such as silicone rubber, is provided on the outer peripheral surface of the base layer 11 and between the outer peripheral surface of the base layer 11 and an inner peripheral surface of the release layer 12. The presence of the elastic layer 13 allows an unfixed toner image T borne by the recording materials P to be wrapped, enabling the toner image T to be uniformly heated. However, when the elastic layer is excessively thick, the elastic layer 13 has a large heat capacity, and therefore it takes a long time for the temperature of the fixing film 10 to reach a temperature needed to fix the toner image T to the recording material P. This degrades an on-demand property specific to the film heating scheme. Thus, the thickness of the elastic layer 13 is set to 50 μm or more and 500 μm or less. The elastic layer 13 preferably has as high thermal conductivity as possible and the thermal conductivity is preferably 0.5 W/mK or higher. To achieve such a thermal conductivity, a heat conductive filler such as ZnO, Al2O3, SiC, or metallic silicon, is mixed into silicone rubber to adjust the thermal conductivity.

The base layer 11 may be a thin flexible endless belt into which a thin metal, such as SUS or Ni, having a high thermal conductivity, or a heat resistant resin, such as polyimide, polyamide-imide, or PEEK, is formed. As the release layer 12, The outer peripheral surface of the base layer 11 is coated, as the release layer 12, with a unitary fluorine resin, such as PFA, PTFE, or FEP, or a blend of any of these resins or covered, as the release layer 12, with a tube of the unitary fluorine resin or the blend of fluorine resins. The release layer 12 needs to have a thickness of 5 μm or more in view of durability. When the release layer 12 is excessively thick, the thermal conductivity decreases to affect the fixing performance. Thus, the release layer needs to be 50 μm or less in thickness. In the fixing film 10 in Embodiment 1, SUS is used as a material for the base layer 11, and the base layer 11 is 30 μm in thickness and 30 mm in inner diameter. The elastic layer 13 is silicone rubber with a thermal conductivity of 1.3 W/(m·K) and is 275 μm in thickness. A PFA tube is used as the release layer 12. The release layer 12 is 20 μm in thickness in order to exhibit high fixing performance.

2-2) Heater Holder

The heater holder 41, serving as a support member, is shaped like a tub with a semicircular transverse section using a heat resistant resin, such as a liquid crystal polymer, a phenol resin, PPS, or PEEK. On a lower surface of the heater holder 41 (the surface closer to the pressuring roller 20), a recess-shaped groove 41*a* is formed along a longitudinal direction of the heater holder 41 as depicted in FIG. 2B. The recess-shaped groove 41*a* holds (supports) the heater 30. The fixing film 10 is loosely externally fitted over an outer periphery of the heater holder 41. The heater holder 41 over which the fixing film 10 is externally fitted is held at longitudinally opposite ends thereof by corresponding opposite ends (not depicted in the drawings) of an apparatus frame 27.

2-3) Pressuring Roller

Figure 4:
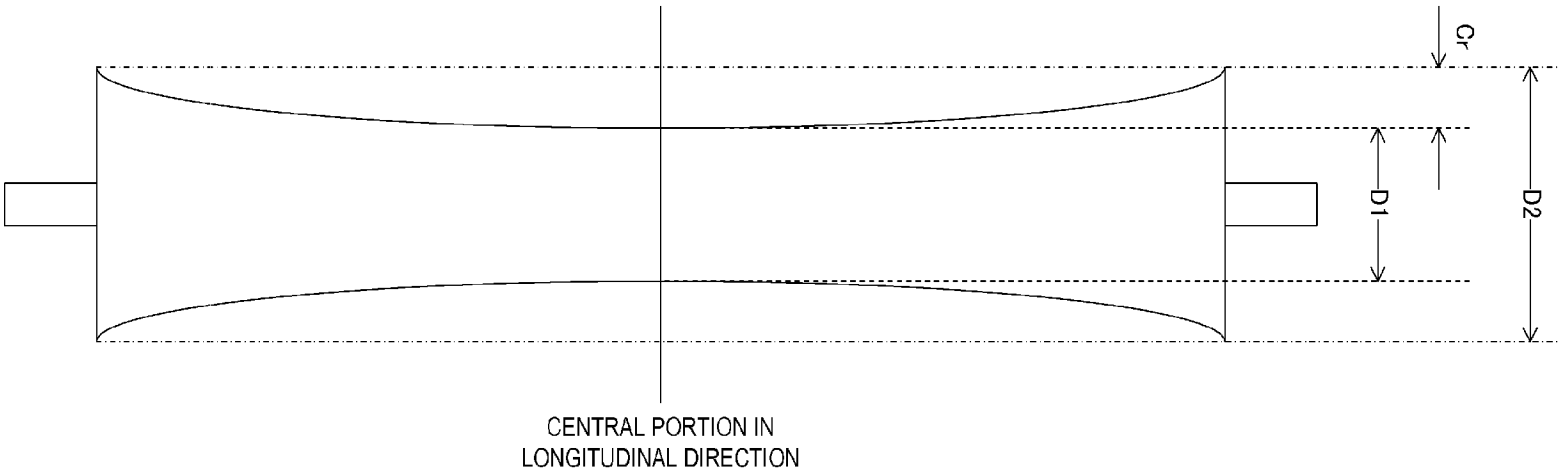
FIG. 4 is a diagram depicting a pressuring roller in Embodiment 1.

With reference to FIGS. 2A and 4, the pressuring roller serving as a pressuring member in Embodiment 1 will be described. FIG. 4 is a diagram depicting the pressuring roller in Embodiment 1. The pressuring roller 20 has a core shaft portion 21, at least one heat-resistant elastic layer 22 provided on an outer peripheral surface of the core shaft portion 21, and a release layer 24 provided on an outer peripheral surface of the heat-resistant elastic layer 22. The heat-resistant elastic layer 22 may be a common heat-resistant rubber elastic material, for example, silicone rubber or fluorine rubber. The release layer 24 is formed by coating the heat-resistant elastic layer 22 with a unitary fluorine resin such as PFA, PTFE, or FEP or a blend of any of these resins or covering the heat-resistant elastic layer 22 with a tube of the unitary fluorine resin or the blend of fluorine resins. In Embodiment 1, an iron cored bar with ϕ 22 mm was used as the cored shaft portion 21, and silicone rubber with a thickness of 4 mm was used as the heat-resistant elastic layer 22. The heat-resistant elastic layer 22 was covered with 50 um of PFA tube as the release layer 24.

As depicted in FIG. 4, the pressuring roller 20 in Embodiment 1 is shaped like an inverted crown having a larger outer diameter at ends of the pressuring roller 20 (second diameter portion) than at a central portion thereof (first diameter portion) in the longitudinal direction. When an inverted crown amount Cr is defined by the half of a difference between the diameter D2 (second diameter) of the pressuring roller 20 at the ends thereof in the longitudinal direction and the diameter D1 (first diameter) of the pressuring roller 20 at the central portion thereof in the longitudinal direction, the inverted crown amount Cr in Embodiment 1 is 0.15 mm. Thus, when the pressuring roller 20 has an inverted crown shape, a conveying speed for the recording material P based on rotation of the pressuring roller 20 is higher at the vicinities of the opposite ends of the pressuring roller 20 than the central portion thereof. When conveyed through the fixing nip, the recording material P is subjected to a force pulling the recording material P from the central portion toward the opposite ends. Thus, the recording material P can be restrained from being wrinkled.

2-4) Heater

The heater 30 is a plate-like heating element that heats the fixing film 10 in contact with an inner peripheral surface of the fixing film 10. The heater 30 has a substrate that is elongate in the longitudinal direction. The substrate may be a ceramic substrate, such as alumina or aluminum nitride, or a heat-resistant rein substrate, such as polyimide, PPS, or a liquid crystal polymer. A back surface of the substrate (the surface opposite to the pressuring roller 20) is coated with a heating resistor, for example, Ag/Pd (silver palladium), RuO2, or Ta2N, which is formed like a band along a longitudinal direction of the substrate. On the back surface of the substrate, a glass coat is also formed, which protects and insulates the heating resistor. On a front surface of the substrate (the surface facing the pressuring roller 20), a sliding layer is provided in order to allow the substrate to slide properly. As the sliding layer, a heat-resistant resin such as polyimide or polyamide-imide or a glass coat may be used. In Embodiment 1, the substrate of the heater 30 has dimensions of 350 mm in the longitudinal direction, 10 mm in a transverse direction (the conveying direction of the recording material), and 0.6 mm in a thickness direction.

2-5) Pressuring Stay

The pressuring stay 42 serving as a reinforcing member is formed to have an inverted U-shaped transverse section using a material, such as metal, which has rigidity. The pressuring stay 42 is arranged inside the fixing film 10 on an upper surface of the heater holder 41 (the surface opposite to the pressuring roller 20) in the center thereof in a transverse direction. Longitudinally opposite ends of the pressuring stay 42 are biased toward an axis of the pressuring roller 20 by the pressuring means 43 such as a pressuring spring via a fixing flange 45 held by the apparatus frame 27. Thus, the heater 30 is pressed against a surface of the pressuring roller 20 via the fixing film 10.

Figure 5:
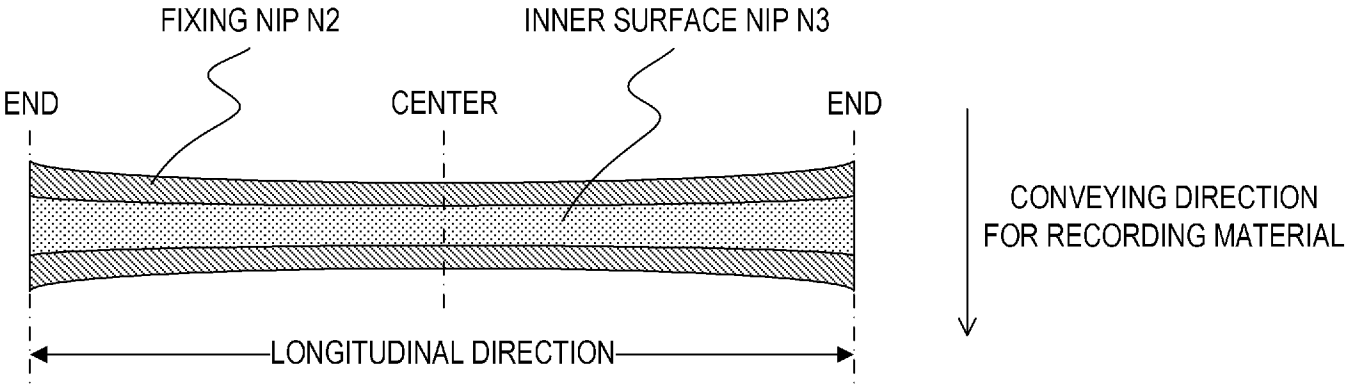
FIG. 5 is a diagram depicting the shapes of a fixing nip and an inner surface nip in Embodiment 1.

As depicted in FIG. 5, an inner surface nip N3 with a predetermined width is formed between the heater 30 and the fixing film 10, and the fixing nip N2 with a predetermined width is formed between the fixing film 10 and the pressuring roller 20. For convenience of description, the inner surface nip N3 and the fixing nip N2 may also collectively be referred to as a nip. The inner surface nip N3 allows heat needed to heat and fix the toner image T to be transferred from the heater 30 to the fixing film 10. The fixing nip N2 allows heat to be transferred from the fixing film 10 to the recording material P.

The fixing nip N2 as used herein refers to an area where the fixing film 10 and the pressuring roller 20 contact each other and where the recording material is conveyed.

FIG. 5 is a diagram depicting the shape of the fixing nip and the inner surface nip. In the fixing apparatus in Embodiment 1, since the pressuring roller 20 is shaped like an inverted crown as described above, the widths of the fixing nip N2 and the inner surface nip N3 vary in the longitudinal direction and are larger at the ends of the pressuring roller 20 than at the central portion thereof.

2-6) Fixing Operation of the Fixing Apparatus

A rotational driving and temperature control section 44, depicted in FIG. 3 and serving as control means, executes a predetermined rotational driving control sequence in accordance with a print instruction and drives a motor M that is a driving source to rotate a driving gear G provided at an end of the core shaft portion 21 of the pressuring roller 20. Thus, the pressuring roller 20 rotates at a predetermined peripheral speed. At this time, the fixing film 10 is subjected to a turning force that rotates the fixing film 10 in a direction opposite to a rotating direction of the pressuring roller 20 by a frictional force exerted between the surface of the pressuring roller 20 and the surface of the fixing film 10 at the fixing nip N2. Thus, the fixing film 10 is driven to rotate outside the heater holder 41 at substantially the same peripheral speed at which the pressuring roller 20 rotates, such that an inner surface of the fixing film 10 is in contact with the sliding layer of the heater 30.

The rotational driving and temperature control section 44 also executes a predetermined temperature control sequence in accordance with a print instruction to pass a current through the heating resistor of the heater 30. The current passage causes the heating resistor to generate heat to rapidly increase the temperature of the heater 30, heating the fixing film 10. The temperature of the fixing film 10 is detected by a thermistor 35 (see FIG. 2A) provided inside the fixing film 10 and serving as temperature detecting means. The thermistor 35 outputs a temperature detection signal for the fixing film 10 to the control section 44. The thermistor 35 is arranged in an area through which recording materials P of various sizes that can be used for the printer 71 inevitably pass. The rotational driving and temperature control section 44 loads the temperature detection signal from the thermistor 35 and controls the current passage through the heating resistor based on the temperature detection signal so as to set the temperature of the fixing film 10 to a predetermined target value.

With the temperature of the fixing film 10 maintained at the predetermined target value, the recording material P bearing the unfixed toner image T is guided along an inlet guide 28 to the fixing nip N2 and conveyed while being sandwiched between the fixing film 10 and the pressuring roller 20. During the conveyance, the heat of the fixing film 10 being heated by the heater 30 and the pressure of the fixing nip N2 are applied to the recording material P and serve to fix the toner image T on the surface of the recording material P. The recording material P having passed through the fixing nip N2 is curvedly separated from the fixing film 10 and discharged by a fixing sheet-discharging roller 26.

(3) Shape of the Protruding Portion 3-1) Shape of the Protruding Portion in Embodiment 1

With reference to FIGS. 2A, 2B and 6A to 8, the protruding portion 41*b* of the heater holder 41 in Embodiment 1 will be described below in detail. As depicted in FIG. 2B, the protruding portion 41*b* protrudes toward a central axis of the pressuring roller 20 (in a direction approaching the pressuring roller 20) by a protruding distance h from a sliding surface. In the fixing film in Embodiment 1, the protruding distance h is 0.2 mm. The sliding surface is a surface of the heater 30 on which the fixing film 10 slides. The protruding portion 41*b* presses the recording material P by the strongest force within the fixing nip N2 at least except for the central portion thereof in the conveying direction of the recording material P.

Figure 6A:
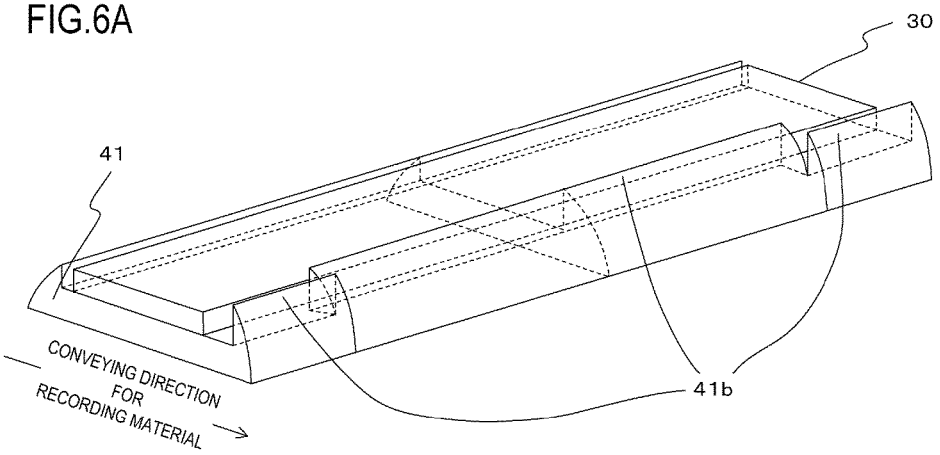
FIGS. 6A and 6B are diagrams depicting a heater holder and a heater in Embodiment 1.
Figure 6B:
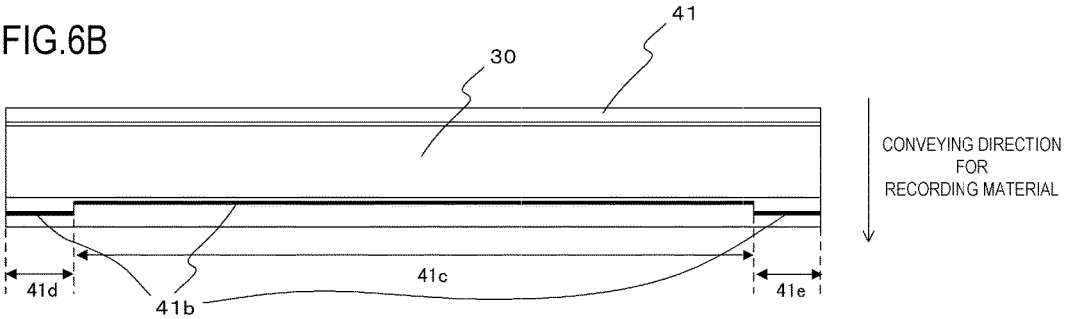

FIGS. 6A and 6B are diagrams depicting the heater holder and the heater in Embodiment 1. FIG. 6A is perspective view of the appearance of the heater holder and the heater. FIG. 6B is a diagram of the heater holder and the heater as viewed from a heater attachment surface. In Embodiment 1, the position of the protruding portion 41*b* provided on the heater holder 41 in the conveying direction of the recording material P varies in the longitudinal direction. Specifically, ends of the protruding portion 41*b* in the longitudinal direction are provided on the downstream side of a central portion of the protruding portion 41*b* in the longitudinal direction.

Figure 7A:
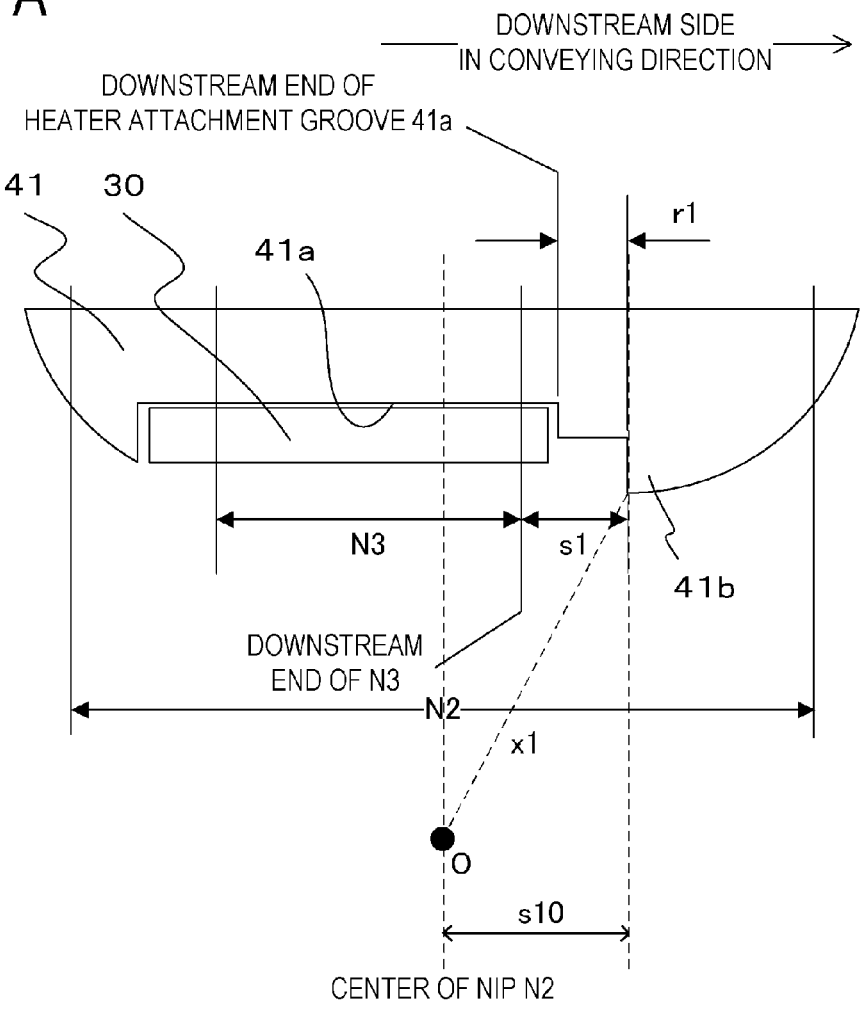
FIGS. 7A and 7B are sectional views depicting the heater holder and the heater in Embodiment 1.
Figure 7B:
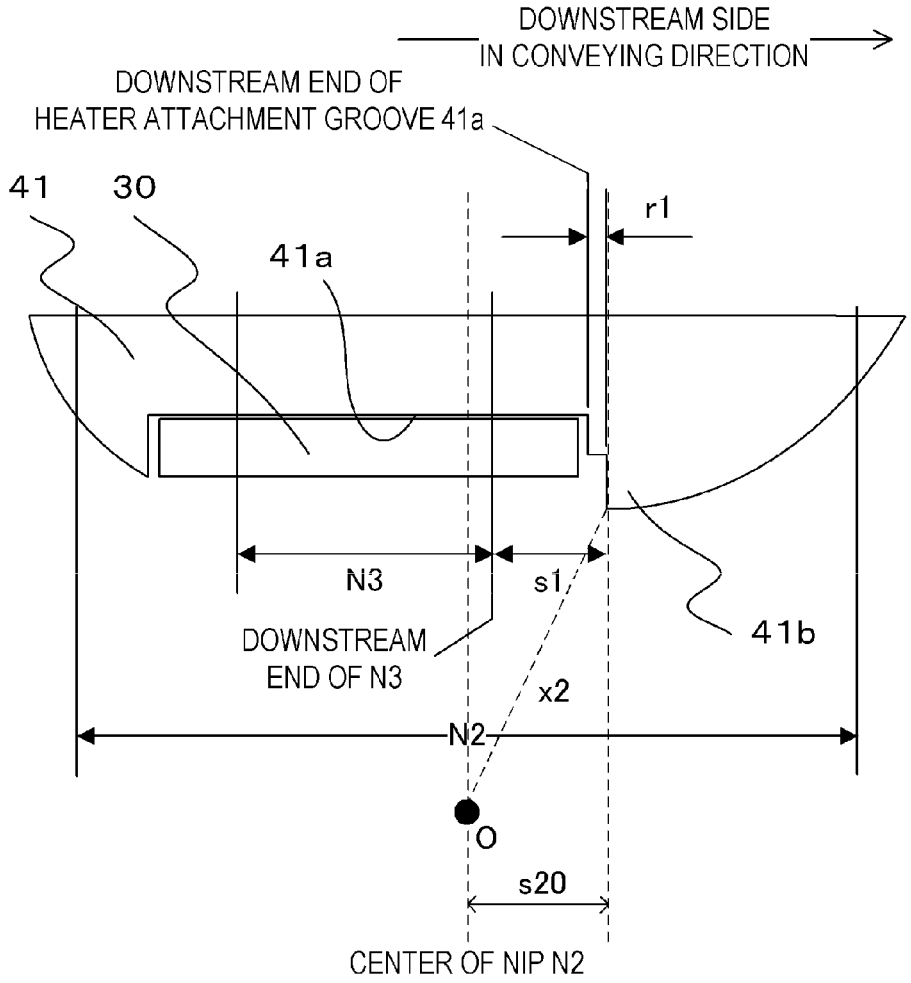

FIGS. 7A and 7B are sectional views depicting the heater holder and the heater holder in Embodiment 1. FIG. 7A is a sectional view of the end in the longitudinal direction, and FIG. 7B is a sectional view of the central portion in the longitudinal direction. The protruding portion 41*b* is provided such that a tip of the protruding portion 41*b* lies at a distance r1 from a downstream end of a heater attachment groove 41*a* in the heater holder 41 in the conveying direction of the recording material P. A distance from a downstream end of the inner surface nip N3 to the tip of the protruding portion 41*b* is denoted as s1. In Embodiment 1, when a distance from the protruding portion 41*b* at each end thereof in the longitudinal direction to a central axis O of the pressuring roller 20 is denoted as x1 and a distance from the protruding portion 41*b* at the central portion thereof in the longitudinal direction to the central axis O of the pressuring roller 20 is denoted as x2, a relation x1>x2 is observed as depicted in FIG. 7. Furthermore, in the conveying direction of the recording material, the central axis of the pressuring roller 20 coincides with the central position of the center of the fixing nip N2. As depicted in FIGS. 7A and 7B, a distance s10 from the fixing nip N2 at each end of the protruding portion in the longitudinal direction to the tip of the protruding portion 41*b* is longer than a distance s20 from the fixing nip N2 at the center of the protruding portion in the longitudinal direction to the tip of the protruding portion 41*b*. In other words, in the present embodiment, each end of the protruding portion 41*b* in the longitudinal direction is provided farther from the center of the fixing nip N2 in the conveying direction of the recording material than the center of the protruding portion 41*b* in the longitudinal direction.

In Embodiment 1, the position of the protruding portion 41*b* is determined based on the position of the inner surface nip N3. Specifically, the protruding portion 41*b* is arranged such that the distance s1 at the central portion is approximately equal to the distance s1 at the end. In the configuration in Embodiment 1, since the inner surface nip N3 is larger at the ends than at the central portion, the protruding portion 41*b* is correspondingly arranged such that the ends are arranged on the downstream side of the central portion. That is, the distance r1 from the downstream end of the heater attachment groove 41*a* in the protruding portion 41*b* involves a relation "central portion<ends". In Embodiment 1, the distance s1 is 2 mm.

Figure 8:
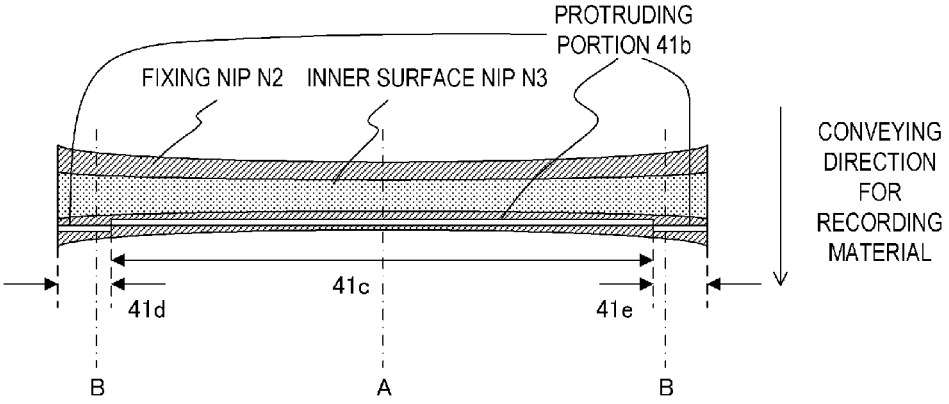
FIG. 8 is a diagram illustrating the positional relation of a protruding portion with a nip in Embodiment 1.

FIG. 8 is a diagram illustrating positional relations of the protruding portion with the fixing nip and the inner surface nip in Embodiment 1. As depicted in FIG. 8, the protruding portion 41*b* in Embodiment 1 is separated into a central portion 41*c* and ends 41*d* and 41*e*. In Embodiment 1, the central portion 41*c* is 285 mm in length, and each of the ends 41*d* and 41*e* is 20 mm in length.

In Embodiment 1, since the pressuring roller 20 is shaped like an inverted crown, the inner surface nip N3 is curved, with the nip width rapidly increasing near the ends. In Embodiment 1, the nip shape is curved, whereas the protruding portion 41*b* is linearly formed in the longitudinal direction. Thus, in each of the areas of the central portion 41*c* and ends 41*d* and 41*e* of the protruding portion 41*b*, the distance s1 is not exactly the same but varies slightly.

Therefore, in Embodiment 1, positions in the central portion and the ends having an equal distance s1 are designated as A in the central portion and as B in the ends. That is, the position of the protruding portion 41*b* is set such that, the distance slat the position A in the central portion is equal to the distance s1 at the position B in each end. The position A corresponds to the center of the protruding portion 41*b* in the longitudinal direction. The position B is at a distance of 148.5 mm from the position A. This is a position where a sheet end passes when an A4-sized sheet is transversally fed. The reason for this definition is that A4-sized recording materials are most frequently used. However, the positions A and B are not limited to this. For example, the position B may correspond to a center of the end 41*d* (end 41*e*) of the protruding portion 41*b* in the longitudinal direction, that is, a position at a distance of 152.5 mm from the position A in Embodiment 1.

3-2) Shape of the Protruding Portion in the Comparative Example

Figure 9A:
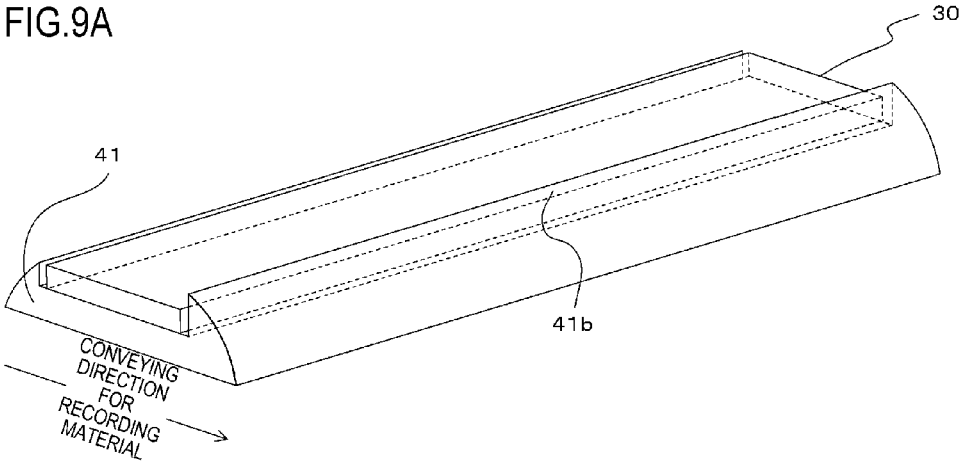
FIGS. 9A and 9B are diagrams depicting the heater holder and the heater in a comparative example.
Figure 9B:
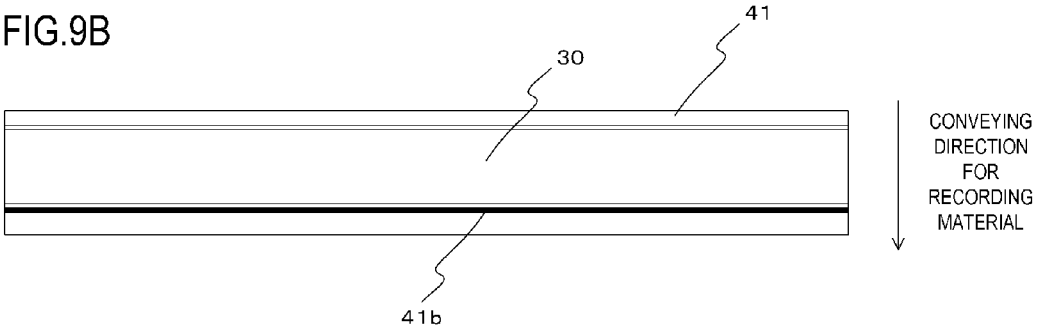
Figure 10A:
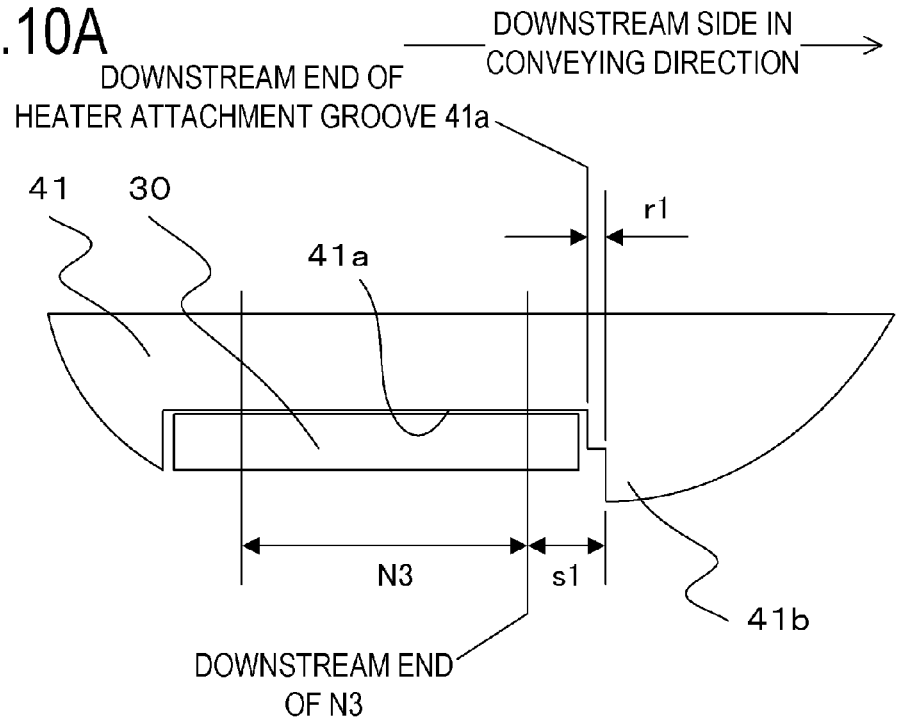
FIGS. 10A and 10B are sectional views depicting the heater holder and the heater in the comparative example.
Figure 10B:
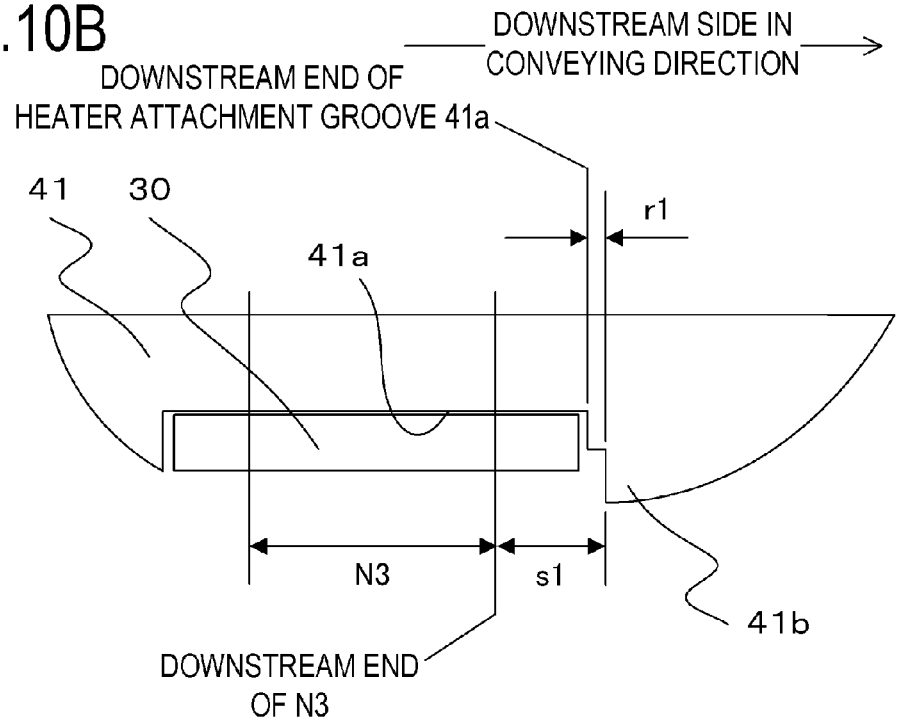
Figure 11:
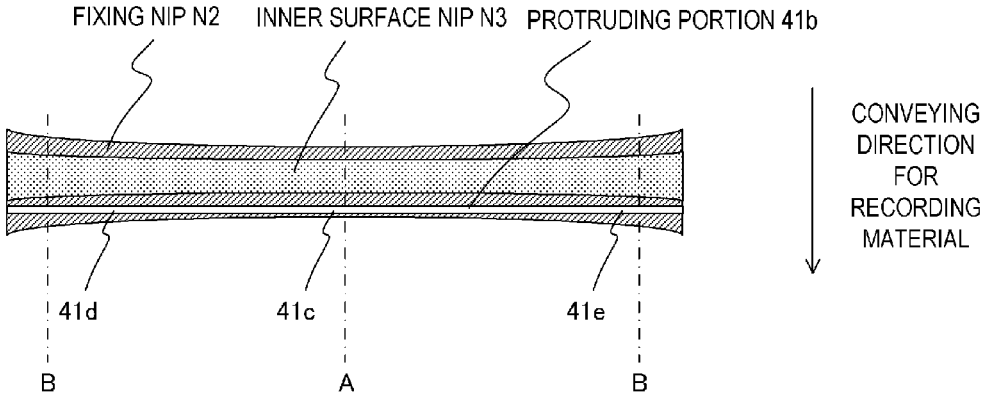
FIG. 11 is a diagram illustrating the positional relation of the protruding portion with the nip in the comparative example.

With reference to FIGS. 9A to 11, the protruding portion 41*b* of the heater holder 41 in the comparative example will be described. FIGS. 9A and 9B are diagrams depicting the heater holder and the heater in the comparative example. FIG. 9A is a perspective view of the appearance of the heater holder and the heater. FIG. 9B is a diagram of the heater holder and the heater as viewed from the heater attachment surface. The protrusion amount h of the protruding portion 41*b* in the comparative example is 0.2 mm as is the case with Embodiment 1. FIGS. 10A and 10B are sectional views depicting the heater holder and the heater in the comparative example. FIG. 10A is a sectional view of the end in the longitudinal direction, and FIG. 10B is a sectional view of the central portion in the longitudinal direction. FIG. 11 is a diagram illustrating the positional relations of the protruding portion with the fixing nip and the inner surface nip in the comparative example.

In the comparative example, the protruding portion 41*b* is arranged at the same position in the conveying direction of the recording material so as to extend uniformly in the longitudinal direction. The distance r1 from the downstream end of the heater attachment groove 41*a* in the heater holder 41 to the tip of the protruding portion 41*b* is equal at the central portion 41*c* and at each of the ends 41*d* and 41*e*. The distance s1 from the downstream end of the inner surface nip N3 to the protruding portion 41*b* involves the relation "central portion>ends". In the comparative example, the distance s1 is 2 mm at the central portion and 1.7 mm at each end.

(4) Effects of Embodiment 1

Figure 12A:
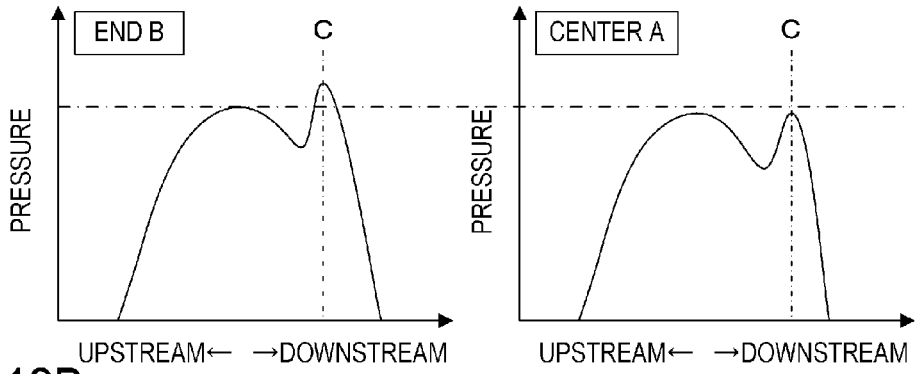
FIGS. 12A, 12B, and 12C are graphs illustrating pressure distributions in Embodiment 1 and the comparative example.
Figure 12B:
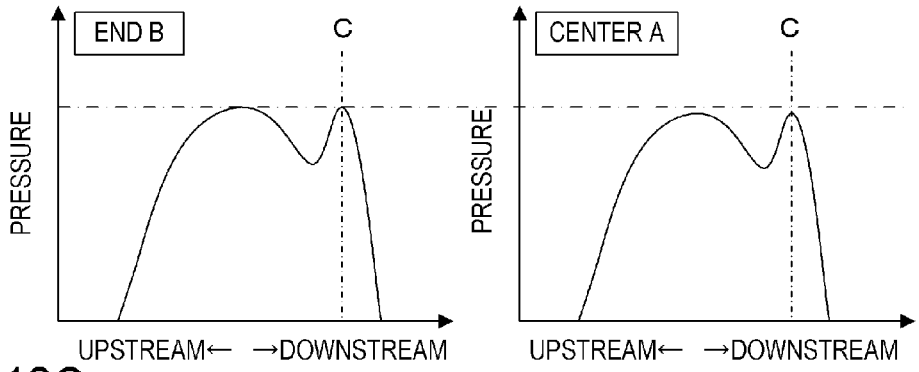
Figure 12C:
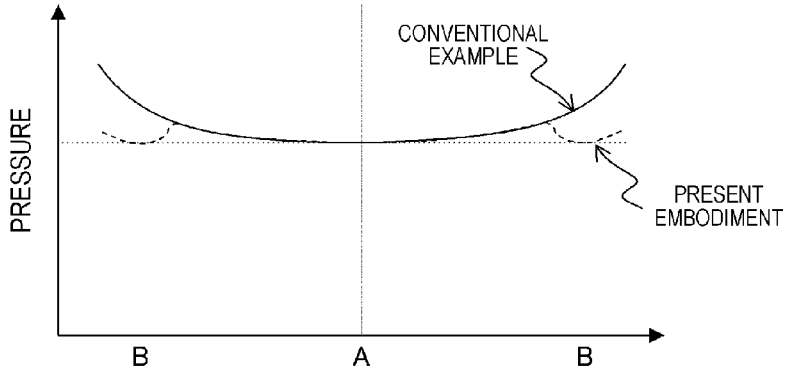

Now, with reference to FIGS. 12A, 12B, and 12C, the effects of Embodiment 1 for a pressure distribution, a gloss value, and the durability of the release layer 12 of the fixing film 10 will be described in comparison with the comparative example. First, the results of the comparison with the distribution of pressure in the conveying direction of the recording material P in the comparative example will be described. FIGS. 12A, 12B, and 12C are graphs illustrating pressure distributions in the fixing nip in Embodiment 1 and the comparative example. FIG. 12A illustrates the pressure distribution of the fixing nip at the central portion A and at the ends B in the conveying direction of the recording material P in the comparative example.

Both at the ends and at the central portion in the longitudinal direction, a peak C of the pressure is present on the downstream side in the conveying direction. The pressure peak C is formed by the protruding portion 41*b* of the heater holder 41. In the configuration in the comparative example, the penetration level of the protruding portion 41*b* into the pressuring roller 20 is higher at the ends B than at the central portion A, and thus, the pressure peak formed on the downstream side in the conveying direction is higher at the ends B than at the central portion A.

On the other hand, FIG. 12B illustrates the pressure distribution of the fixing nip at the central portion A and at the ends B in the conveying direction of the recording material P in Embodiment 1. In Embodiment 1, the protruding portion 41*b* at the ends B is shifted downstream in the conveying direction of the recording material P with respect to the protruding portion 41*b* at the ends B in the comparative example. This reduces the penetration level of the protruding portion 41*b* into the pressuring roller 20, leading to a lower peak formed on the downstream side. Thus, the pressure exerted by the protruding portion 41*b* is substantially the same at the central portion A and at the ends B.

FIG. 12C is a diagram illustrating a comparison of the distribution of the downstream pressure peak in the longitudinal direction between Embodiment 1 and the comparative example. As illustrated in FIG. 12C, Embodiment 1 enables a reduction in the difference in the pressure peak between the central portion and each end compared to the comparative example. The difference in the pressure peak is manifested as a difference in the gloss value of the toner image fixed on the recording material P.

Figure 13:
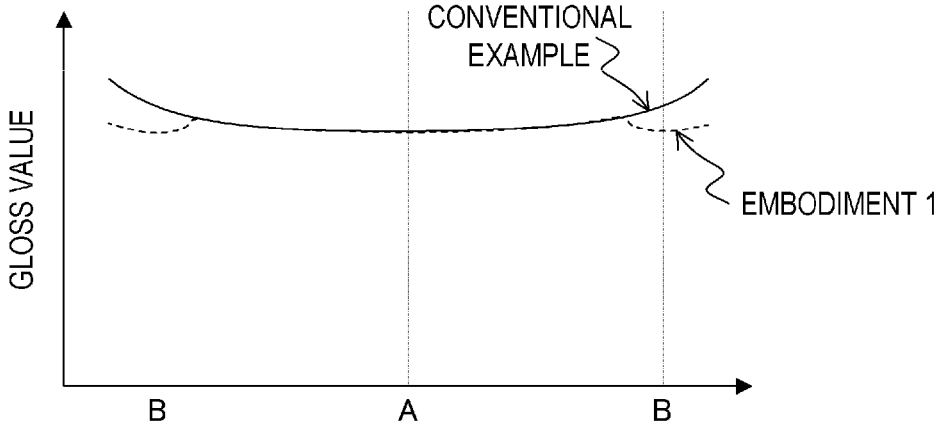
FIG. 13 is a graph illustrating a comparison of the distribution of a gloss value in a longitudinal direction between Embodiment 1 and the comparative example.

FIG. 13 is a graph illustrating a comparison of the distribution of the gloss value in the longitudinal direction between Embodiment 1 and the comparative example. Since Embodiment 1 enables a reduction in the difference in the pressure peak between the central portion and each end compared to the comparative example, Embodiment 1 also enables a reduction in gloss value between each end and the central portion.

Figure 14:
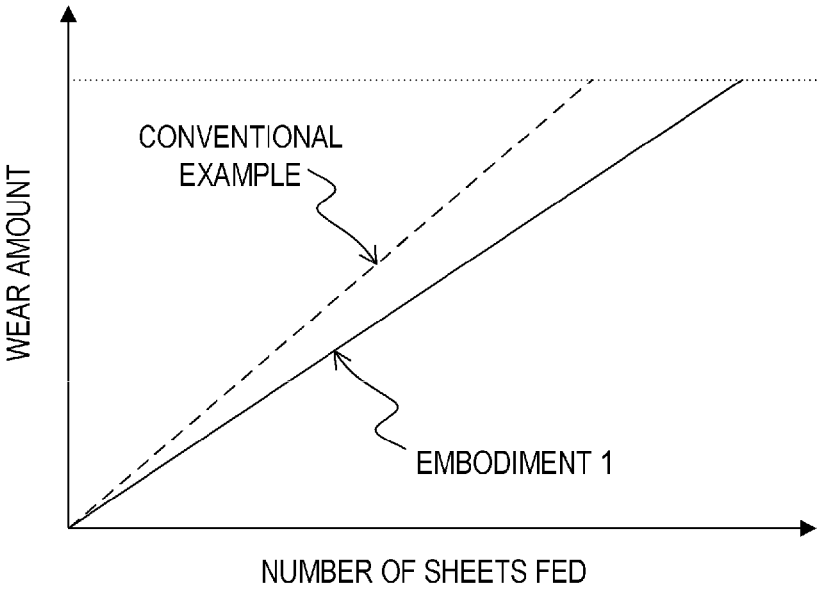
FIG. 14 is a graph illustrating a comparison of the transition of a wear amount between the comparative example and Embodiment 1.

Now, the results of a comparison with the comparative example for the durability of the release layer 12 of the fixing film 10 against wear will be described. FIG. 14 is a graph illustrating a comparison between the comparative example and Embodiment 1 for the transition of a wear amount by which the release layer 12 of the fixing film 10 is rubbed by an edge of the recording material P. In the comparative example, a high pressure peak is formed on the downstream side in the conveying direction of the recording material P by the protruding portion 41*b*, leading to fast progress of wear. On the other hand, in Embodiment 1, the downstream pressure peak is set lower than the downstream pressure peak in the comparative example, enabling the progress of wear to be suppressed more appropriately than in the comparative example.

As described above, Embodiment 1 allows a lower pressure peak to be formed at the ends in the longitudinal direction than the comparative example, making the pressure peak at the ends in the longitudinal direction substantially the same as the pressure peak at the central portion in the longitudinal direction. Therefore, Embodiment 1 enables a reduction in the difference in gloss value between the central portion and each end and improvement of the durability of the release layer 12 against wear. As a result, adverse effects on image quality can be suppressed, allowing the life of the fixing apparatus 72 to be restrained from being shortened.

In Embodiment 1, the position of the protruding portion 41*b* is determined based on the distance s1 from the downstream end of the inner surface nip N3 to the tip of the protruding portion 41*b*. However, the present invention need not necessarily be limited to this method. The protruding portion 41*b* may be arranged to make the longitudinal pressure peak substantially uniform. For example, the position of the protruding portion 41*b* may be determined according to the width of the fixing nip N2. This also applies to other embodiments described later.

As described above, the protruding portion 41*b* is configured such that a minimum distance x1 from a part of the protruding portion 41*b* that comes into pressure contact with the second diameter portion (with a relatively large diameter) of the pressuring roller 20 to the central axis O of the pressuring roller 20 is shorter than a minimum distance x2 from a part of the protruding portion 41*b* that comes into pressure contact with the first diameter portion (with a relatively small diameter) of the pressuring roller 20 to the central axis O of the pressuring roller 20 (see FIGS. 7A and 7B). This also applies to the other embodiments described below. In Embodiment 1, the part of the protruding portion 41*b* that comes into pressure contact with the second diameter portion of the pressuring roller 20 is provided downstream, in the conveying direction of the recording material P, of the part of the protruding portion 41*b* that comes into pressure contact with the first diameter portion of the pressuring roller 20. In the present embodiment, the pressuring roller is used as the pressuring member. However, the pressuring member need not necessarily be the pressuring roller. The pressuring means may be a pad.

Embodiment 2

Now, with reference to FIGS. 15A to 17, Embodiment 2 of the present invention will be described. The basic configuration and operation of the fixing apparatus in Embodiment 2 are the same as the configuration and operation of the fixing apparatus in Embodiment 1. Therefore, elements of Embodiment 2 having functions and configurations identical to or corresponding to the functions and configurations in the fixing apparatus in Embodiment 1 are denoted by the same reference numerals as those in Embodiment 1. A detailed description of these elements is omitted. Characteristic points of Embodiment 2 will be described. This also applies to the subsequent embodiments.

Figure 15A:
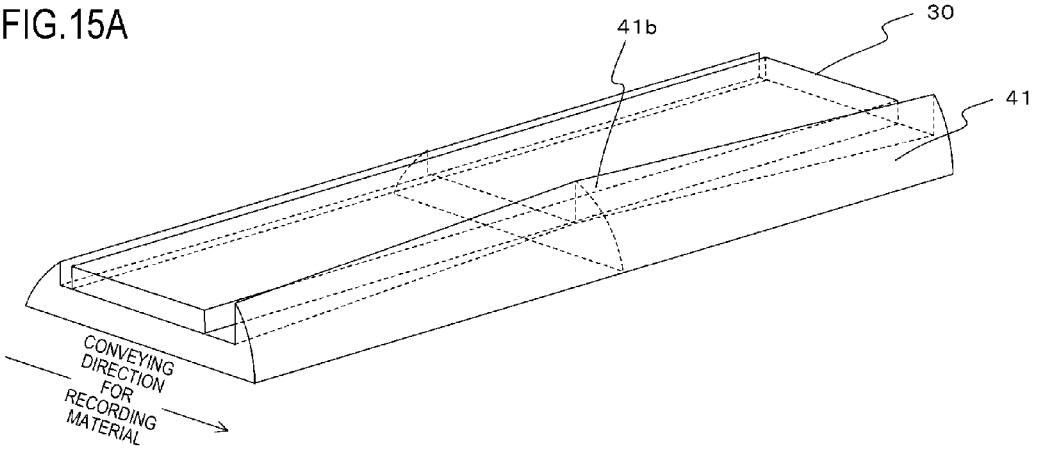
FIGS. 15A and 15B are diagrams depicting the heater holder and the heater in Embodiment 2.
Figure 15B:
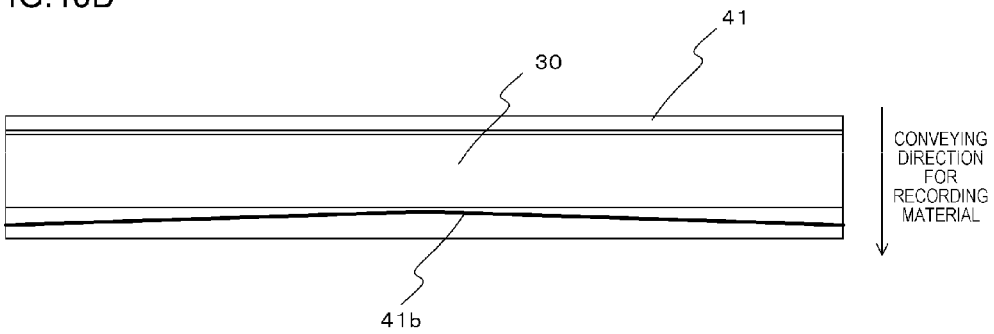

FIGS. 15A and 15B are diagrams depicting the heater holder and the heater in Embodiment 2. FIG. 15A is a perspective view of the appearance of the heater holder and the heater. FIG. 15B is a diagram of the heater holder and the heater as viewed from the heater attachment surface. As is the case with Embodiment 1, the protruding portion 41*b* in Embodiment 2 is formed on the downstream of the central portion in the conveying direction of the recording material P, and each of the ends is arranged on the downstream side of the central portion. The protruding portion 41*b* in Embodiment 2 is not discontinuous at a boundary between the central portion 41*c* and each of the ends 41*d* and 41*e* in contrast to the protruding portion 41*b* in Embodiment 1, but is continuous at the boundary so as to form a V shape as depicted in FIG. 15B.

Figure 16:
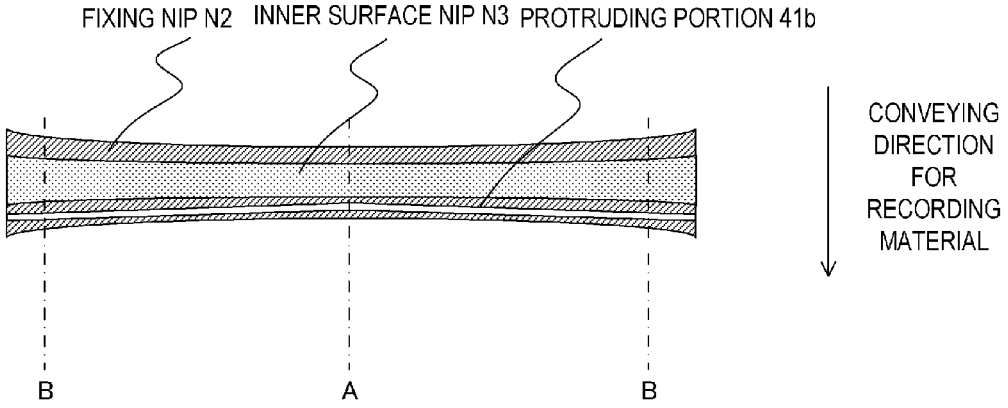
FIG. 16 is a diagram illustrating the positional relation of the protruding portion with the nip in Embodiment 2.

FIG. 16 is a diagram illustrating the positional relation of the protruding portion 41*b* with respect to the shapes of the fixing nip N2 and the inner surface nip N3 in Embodiment 2. The inner surface nip N3 is curved as is the case with Embodiment 1. The protruding portion 41*b* of Embodiment 2 is formed somewhat along the downstream end of the inner surface nip N3. Specifically, the protruding portion 41*b* is arranged such that the distance s1 between the downstream end of the inner surface nip N3 and the protruding portion 41*b* is equal at the central portion A and at the ends B and such that the protruding portion 41*b* at the central portion A is in line with the protruding portion 41*b* at each of the ends B. Therefore, unlike in Embodiment 1, the distance s1 between the downstream end of the inner surface nip N3 and the protruding portion 41*b* is prevented from changing rapidly at the boundary between the central portion 41*c* and each of the ends 41*d* and 41*e*.

Figure 17:
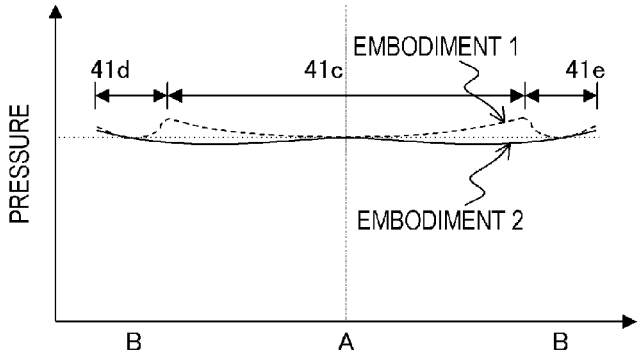
FIG. 17 is a graph illustrating a comparison between Embodiment 2 and Embodiment 1 for the distribution of pressure exerted by the protruding portion in the longitudinal direction.

FIG. 17 is a graph illustrating a comparison between Embodiment 2 and Embodiment 1 for the distribution of pressure exerted by the protruding portion 41*b* in the longitudinal direction. As illustrated in FIG. 17, in Embodiment 1, the protruding portion 41*b* is discontinuous at the boundary between the central portion 41*c* and each of the ends 41*d* and 41*e*, and thus, the distance s1 between the downstream end of the inner surface nip N3 and the protruding portion 41*b* changes rapidly at the boundary, leading to a rapid change in pressure peak near the boundary. In contrast, in Embodiment 2, the protruding portion 41*b* has no boundary between the central portion 41*c* and each of the ends 41*d* and 41*e* but is continuous, avoiding a rapid change in the distance s1 between the downstream end of the inner surface nip N3 and the protruding portion 41*b* unlike in Embodiment 1. Thus, in Embodiment 2, the pressure peak can be changed gradually in the longitudinal direction. Therefore, Embodiment 2 enables a reduction in the difference in pressure peak between the central portion 41*c* and each of the ends 41*d* and 41*e* as in Embodiment 1, providing images with a variation in gloss value reduced near the boundaries.

Embodiment 3

Figure 18A:
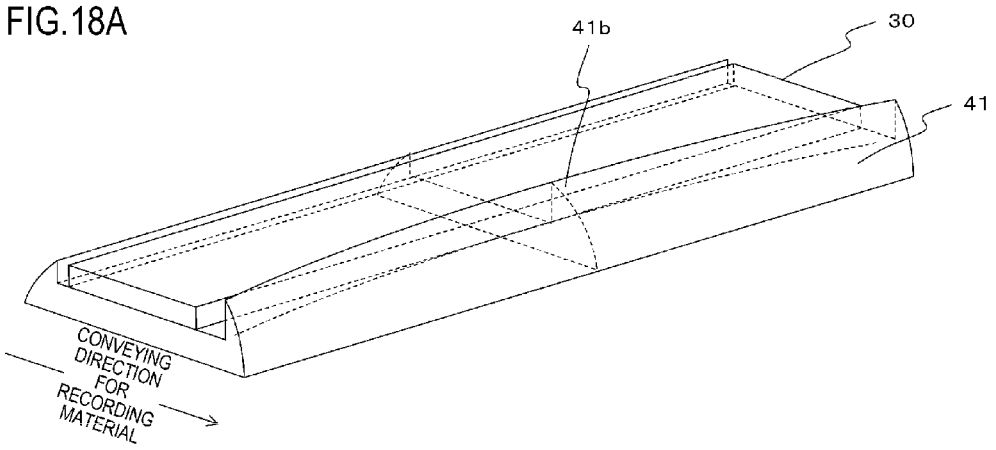
FIGS. 18A and 18B are diagrams depicting the heater holder and the heater in Embodiment 3.
Figure 18B:
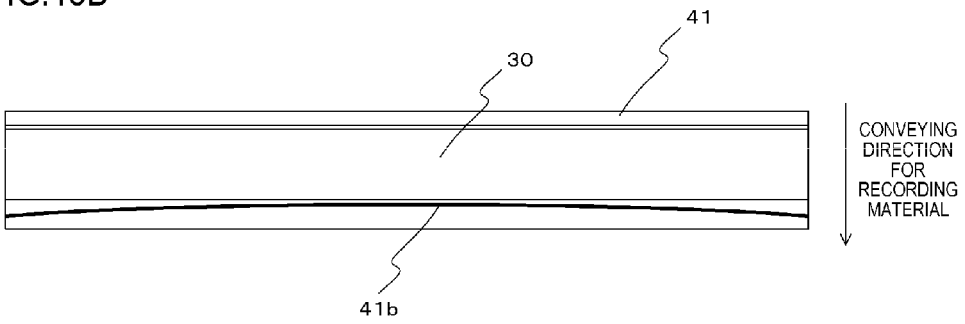
Figure 19:
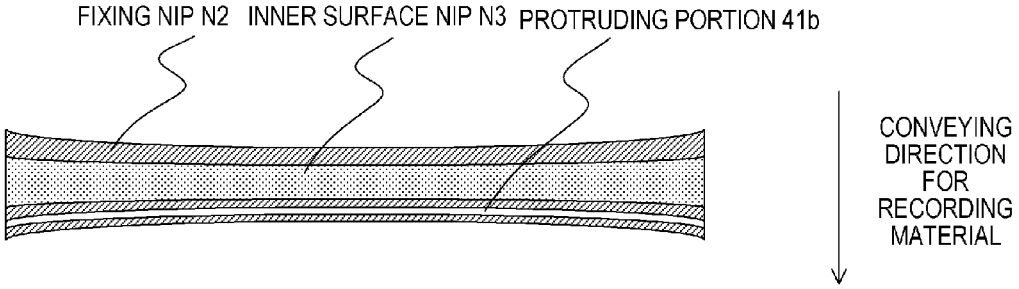
FIG. 19 is a diagram illustrating the positional relation of the protruding portion with the nip in Embodiment 3.

Now, with reference to FIGS. 18A to 20, Embodiment 3 of the present invention will be described. FIGS. 18A and 18B are diagrams depicting the heater holder and the heater in Embodiment 3. FIG. 18A is a perspective view of the appearance of the heater holder and the heater. FIG. 18B is a diagram of the heater holder and the heater as viewed from the heater attachment surface. The protruding portion 41*b* in Embodiment 3 is not linear in contrast to the protruding portion 41*b* in Embodiments 1 and 2 but is gently curved. FIG. 19 is a diagram illustrating the positional relations of the protruding portion 41*b* with the fixing nip N2 and the inner surface nip N3 in Embodiment 3. As illustrated in FIG. 19, the inner surface nip N3 is curved as is the case with Embodiments 1 and 2. In Embodiment 3, the protruding portion 41*b* is curved along the nip shaped. Specifically, the position of the protruding portion 41*b* is set such that the distance s1 between the downstream end of the inner surface nip N3 and the tip of the protruding portion 41*b* is equal all along the protruding portion 41*b* in the longitudinal direction. This is in contrast to Embodiments 1 and 2 in which the distance s1 is equal only at the limited positions, for example, at the central portion A and at the ends B.

Figure 20:
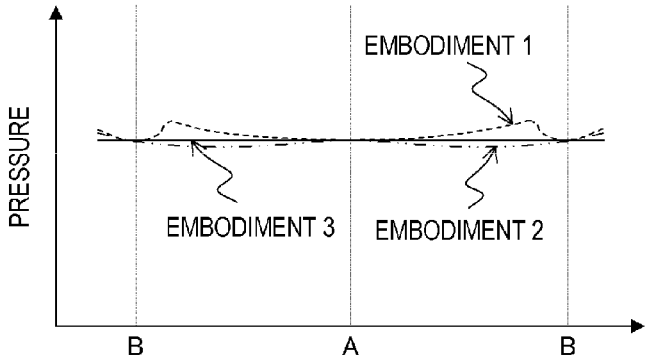
FIG. 20 is a graph illustrating a comparison of Embodiments 1 to 3 for a pressure peak in the longitudinal direction.

FIG. 20 is a diagram illustrating a comparison of the distribution of the pressure peak in the longitudinal direction among Embodiments 1 to 3. In Embodiments 1 and 2, the inner surface nip N3 is curved, whereas the protruding portion 41*b* is linearly formed. This precludes the distance s1 from the downstream end of the inner surface nip N3 to the tip of the protruding portion 41*b* from being uniform in the longitudinal direction, resulting in a difference in the pressure peak in the longitudinal direction, though slight. Therefore, Embodiments 1 and 2 still involves a variation in gloss value attributed to the pressure peak.

In contrast, in Embodiment 3, the protruding portion 41*b* is formed to have a curved shape conforming to the curved shape of the inner surface nip N3. This allows the pressure peak formed by the protruding portion 41*b* to be made substantially the same all along the protruding portion 41*b* in the longitudinal direction. That is, Embodiment 3 enables a further reduction in the difference in pressure peak in the longitudinal direction compared to Embodiments 1 and 2, providing images with a variation in gloss value eliminated all along the protruding portion 41*b* in the longitudinal direction.

The resultant even pressure peak allows further suppression of uneven wear of the release layer of the fixing film 10 in the longitudinal direction. In connection with the wear resulting from the rubbing between the edge of the recording material P and the fixing film 10, Embodiments 1 and 2 are configured to be maximally effective on the target size of the recording material P. Conversely, the wear amount resulting from recording materials of sizes other than the target size is likely to be slightly larger than the wear amount resulting from recording materials of the target size. For example, in the configuration in Embodiment 1, when the positions A and B where the distance s1 is equal are determined using an A4 size as a target, the wear amount is likely to be larger than the wear amount resulting from the A4 size when recording materials of another size are fed, for example, B4-sized recording materials are longitudinally fed. However, in Embodiment 3, the pressure peak is uniform in the longitudinal direction, and thus, for example, the wear amount of a portion corresponding to the edge of the recording material P can be made the same for recording materials of all sizes without limitation to the A4 size.

As described above, in Embodiment 3, the shape of the protruding portion 41*b* is curved so as to conform to the curved shape of the inner surface nip N3. Thus, compared to Embodiments 1 and 2, Embodiment 3 suppresses a variation in the pressure peak to restrain a variation in the gloss value and the uneven wear of the fixing film surface. In Embodiment 3, the position of the protruding portion 41*b* is set such that the distance s1 from the downstream end of the inner surface nip N3 is equal all along the protruding portion 41*b* in the longitudinal direction. However, the distance s1 need not necessarily be equal all along the protruding portion 41*b* in the longitudinal direction. The protruding portion 41*b* is curved in accordance with the curved nip shape as in Embodiment 3 to allow suppression of a variation in the gloss value or in the wear amount of the release layer of the fixing film. Therefore, as also described in Embodiment 1, the position of the protruding portion 41*b* need not necessarily be determined based on the distance s1, and the distance s1 may vary in the longitudinal direction within an allowable range.

Embodiment 4

Figure 21:
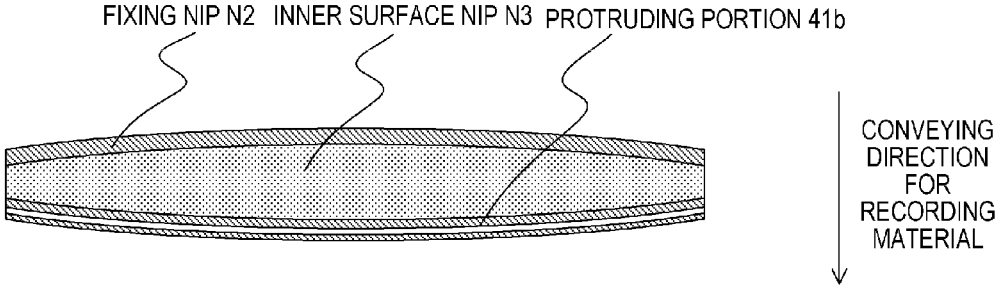
FIG. 21 is a diagram illustrating the positional relation of the protruding portion with the nip in Embodiment 4.

Now, with reference to FIGS. 21 and 22, Embodiment 4 of the present invention will be described. FIG. 21 is a diagram illustrating the positional relations of the protruding portion 41*b* with the fixing nip N2 and the inner surface nip N3 in Embodiment 4. The fixing nip N2 and the inner surface nip N3 in Embodiment 4 have nip widths varying in the longitudinal direction and are each thicker in the center of the nip such that the nip width at the ends (first width) is larger than the nip width at the central portion (second width). To allow such a nip shape to be formed, the pressure applied to the ends is set higher than the pressure applied to the central portion. Specifically, a heater holding surface of the heater holder 41 is made thicker at the central portion than at the opposite ends so as to be shaped to protrude toward the pressuring roller 20. In Embodiment 2, the pressuring roller 20, serving as a roller member, has a diameter that is uniform in the longitudinal direction.

Thus, the penetration level of the heater 30 and the heater holder 41 into the pressuring roller 20 is higher at the central portion than at the ends, allowing the pressure applied to the central portion to be set higher than the pressure applied to the nip ends. The nip that is thicker at the center thereof enables a reduction in the wear amount of the portion of the release layer of the fixing film 10 corresponding to the edge of the recording material P compared to the nip that is thicker at the ends thereof and in which a higher pressure is applied to the nip ends as in Embodiment 1.

Figure 22:
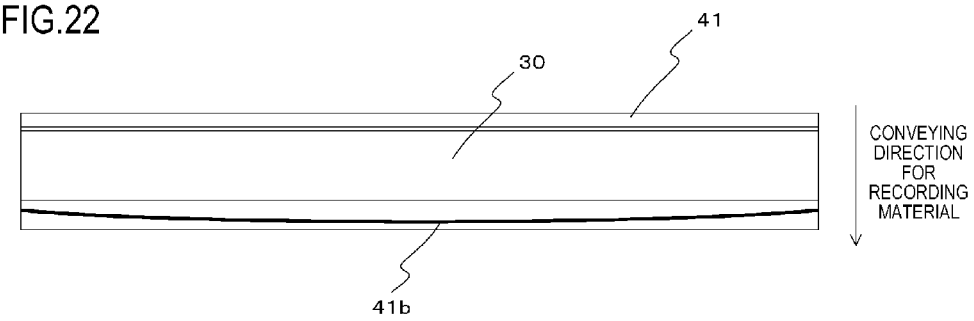
FIG. 22 is a diagram of the heater holder and the heater in Embodiment 4 as viewed from a heater attachment surface.

FIG. 22 is a diagram of the heater holder 41 and the heater 30 in Embodiment 4 as viewed from the heater attachment surface. The protruding portion 41*b* in Embodiment 4 is curved such that the central portion is arranged on the downstream side of the ends. In Embodiment 4, the protruding portion 41*b* is formed along the shape of the downstream end of the inner surface nip N3. Specifically, the position of the protruding portion 41*b* is set such that the distance s1 between the downstream end of the inner surface nip N3 and the tip of the protruding portion 41*b* is equal all along the protruding portion 41*b* in the longitudinal direction. This allows the pressure peak formed by the protruding portion 41*b* to be made substantially the same all along the protruding portion 41*b* in the longitudinal direction. Therefore, images can be obtained in which the gloss value is prevented from varying all along the protruding portion 41*b* in the longitudinal direction.

The resultant even pressure peak allows suppression of uneven wear of the release layer of the fixing film 10 in the longitudinal direction. When the protruding portion 41*b* is arranged straight in the longitudinal direction as in the comparative example described in conjunction with Embodiment 1, the distance s1 from the downstream end of the inner surface nip N3 to the protruding portion 41*b* are shorter at the central portion than at the ends. Therefore, the pressure peak formed by the protruding portion 41*b* is higher at the central portion in the longitudinal direction. As a result, the wear amount of the release layer of the fixing film 10 is larger at the central portion, resulting in wear unevenness in the longitudinal direction. In contrast, in Embodiment 4, an even pressure peak is obtained in the longitudinal direction, allowing the wear at the central portion to be suppressed.

As described above, in Embodiment 4, the inner surface nip N3 is shaped to be thicker at the center thereof, and the shape of the protruding portion 41*b* is curved so as to conform to the curved shape of the inner surface nip N3. This configuration enables a variation in the pressure peak to be reduced to allow suppression of a variation in gloss value or in the wear amount of the fixing film surface. The shape of the protruding portion 41*b* is not limited to the curved shape. For example, the protruding portion 41*b* may be linearly arranged and shaped such that the central portion is displaced toward the downstream side of the ends. Alternatively, the protruding portion 41*b* may be V-shaped such that the central portion is arranged on the downstream side of the ends.

Embodiment 5

Figure 23A:
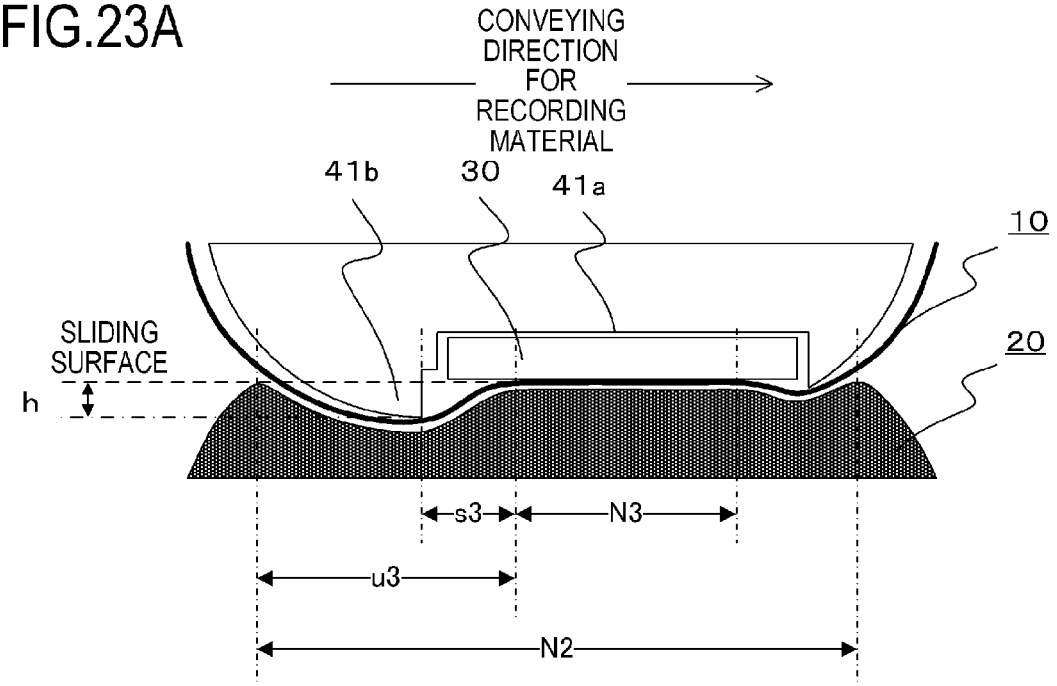
FIGS. 23A and 23B are diagrams illustrating the pressure peak in Embodiment 5.
Figure 23B:
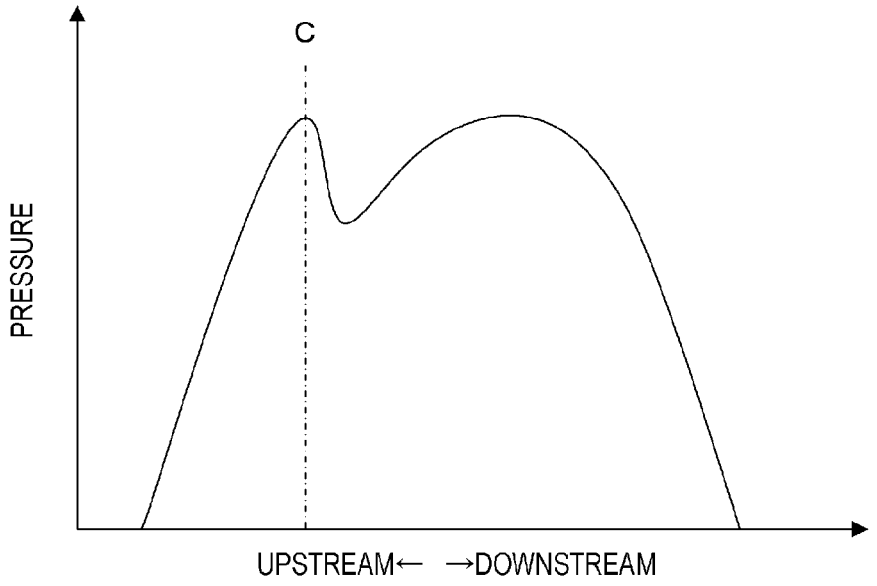

Now, with reference to FIGS. 23A, 23B, 24A and 24B, Embodiment 5 of the present invention will be described. FIGS. 23A and 23B are diagrams illustrating the pressure peak in Embodiment 5. FIG. 23A is an enlarged view of the nip in the fixing apparatus in Embodiment 5. FIG. 23B is a diagram of the pressure distribution of the inner surface nip in the conveying direction of the recording material P in Embodiment 5. As illustrated in the figures, in Embodiment 5, the protruding portion 41*b* of the heater holder 41 is located on an upstream side in the conveying direction of the recording material P. In this case, the pressure distribution in the conveying direction of the recording material P formed by the fixing film 10 and the pressuring roller 20 has a pressure peak C on the upstream side in the conveying direction of the recording material P.

When the pressure peak is thus provided on the upstream side in the conveying direction of the recording material P, the surface of the fixing film 10 can be allowed to conform to the shape of the pressuring roller 20 to enable an increase in a distance between an upstream end of the fixing nip N2 and an upstream end of the inner surface nip N3 (the distance is hereinafter referred to as u3). As a result, the recording material P is warmed for a longer time before reaching the inner surface nip N3. Thus, a preheat effect is exerted to allow high fixing performance and a large gloss value to be achieved.

Figure 24A:
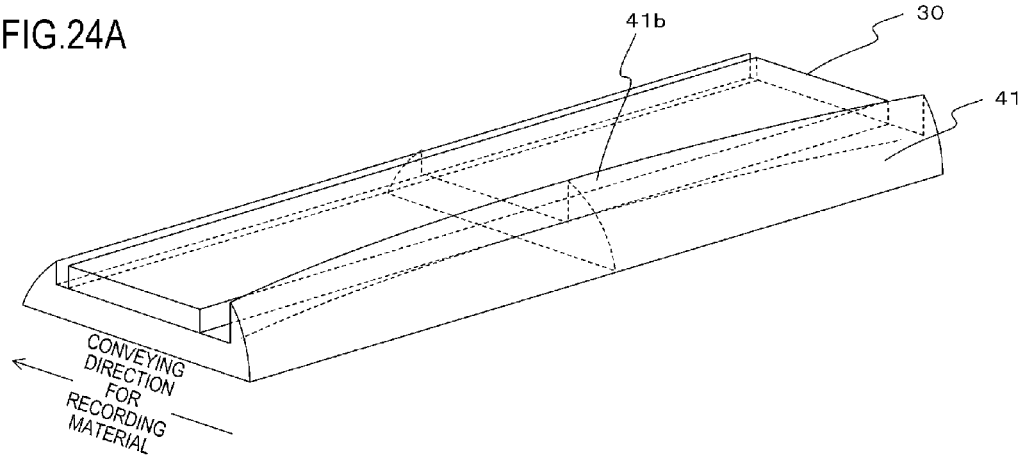
FIGS. 24A and 24B are diagrams of the heater holder and the heater in Embodiment 5.
Figure 24B:
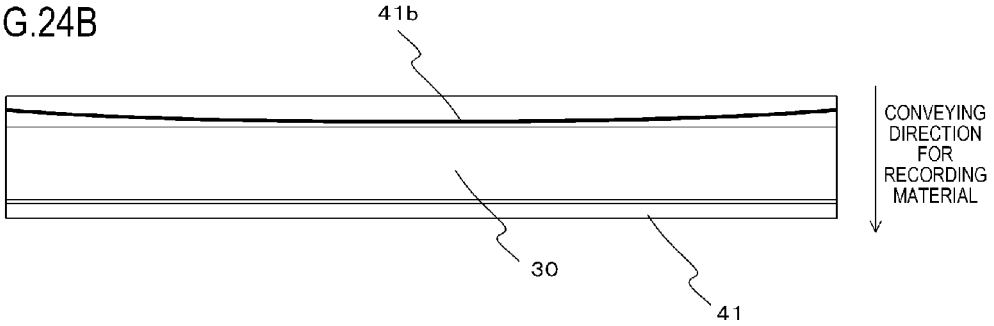

FIGS. 24A and 24B are diagrams depicting the heater holder and the heater in Embodiment 5. FIG. 24A is a perspective view of the appearance of the heater holder and the heater. FIG. 24B is a diagram of the heater holder and the heater as viewed from the heater attachment surface. The inner surface nip N3 is curved as is the case with Embodiments 1 to 3, and the protruding portion 41*b* is formed to conform to the nip shape. Specifically, the position of the protruding portion 41*b* is set such that a distance between the upstream end of the inner surface nip N3 and the protruding portion 41*b* (the distance is hereinafter referred to as s3) is equal all along the protruding portion 41*b* in the longitudinal direction. This allows the pressure peak formed by the protruding portion 41*b* to be made substantially the same all along the protruding portion 41*b* in the longitudinal direction.

The resultant even pressure peak enables a reduction in the wear amount of a portion of the release layer of the fixing film 10 that is rubbed by the end of the recording material P. When the protruding portion 41*b* is arranged straight in the longitudinal direction as in the comparative example, the distance s3 from the upstream end of the inner surface nip N3 to the protruding portion 41*b* is shorter at the ends than at the central portion. Therefore, the pressure peak formed by the protruding portion 41*b* is higher at the ends in the longitudinal direction. This accelerates the wear of the portion of the release layer of the fixing film 10 that is rubbed by the edge of the recording material P. In contrast, Embodiment 5 enables the pressure peak at the ends to be made substantially the same as the pressure peak at the central portion, allowing the wear of the portion of the release layer of the fixing film 10 that is rubbed by the edge of the recording material to be restrained from progressing compared to the related art.

Embodiment 5 achieves an even pressure peak to allow suppression of a variation in gloss value and in fixing performance attributed to the pressure peak, providing images with a reduced variation in gloss value and in fixing performance all along the protruding portion 41*b* in the longitudinal direction. As described above, in Embodiment 5, the pressure peak provided by the protruding portion 41*b* can be made substantially the same all along the protruding portion 41*b* in the longitudinal direction. Therefore, a variation in gloss value and in fixing performance can be suppressed, enabling durability of the release layer 12 against wear.

Embodiment 6

Now, with reference to FIGS. 25 to 27C, Embodiment 6 of the present invention will be described. FIGS. 26A, 26B, and 26C are diagrams illustrating a comparison of the configuration between Embodiment 6 and Comparative Example 2. FIG. 26A is a diagram of the heater holder and the heater in Embodiment 6 as viewed from the downstream side in the conveying direction of the recording material.

FIG. 26B is a diagram of the heater holder and the heater in Embodiment 6 as viewed from the heater attachment surface. FIG. 26C is diagram of the heater holder and the heater in Comparative Example 2 as viewed from the heater attachment surface.

In Embodiment 6, the protruding distance of the protruding portion 41*b* of the heater holder 41 varies in the longitudinal direction. The protruding distance (second protruding distance) at the ends (second protruding portion) is longer than the protruding distance (first protruding distance) at the central portion (first protruding portion). In Embodiment 6, the protruding distance h is 0.2 mm at the central portion and 0.35 mm at the ends. Thus, the recording material P having passed through the fixing nip N2 can be curved in the longitudinal direction and thus shaped to protrude toward the fixing film 10. As a result, the recording material P can be made rigid in the longitudinal direction so as to be difficult to bend in the conveying direction. Therefore, the behavior of the recording material P can be regulated to allow the recording material P to be stably conveyed. As depicted in FIG. 26B, the protruding portion 41*b* in Embodiment 6 is gently curved such that the ends (second protruding portion) are arranged on the downstream side of the central portion (first protruding portion).

Now, Comparative Example 2 will be described in comparison with Embodiment 6. Also for the heater holder 41 in Comparative Example 2, the protruding distance h varies in the longitudinal direction and is longer at the ends than at the central portion as illustrated in FIG. 26A. The protruding distance h in Comparative Example 2 is such that the protruding distance h is 0.2 mm at the central portion and 0.35 mm at the ends as is the case with Embodiment 6. In Comparative Example 2, the protruding portion 41*b* is arranged at the same position in the conveying direction of the recording material P so as to extend uniformly in the longitudinal direction as depicted in FIG. 26C.

Figure 25:
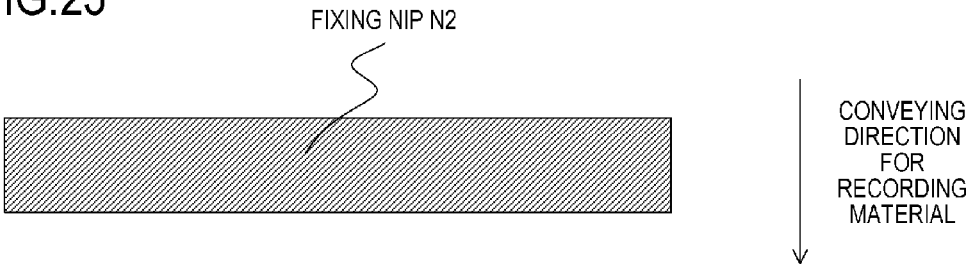
FIG. 25 is a diagram depicting the shape of a fixing nip in Embodiment 6.
Figure 26A:
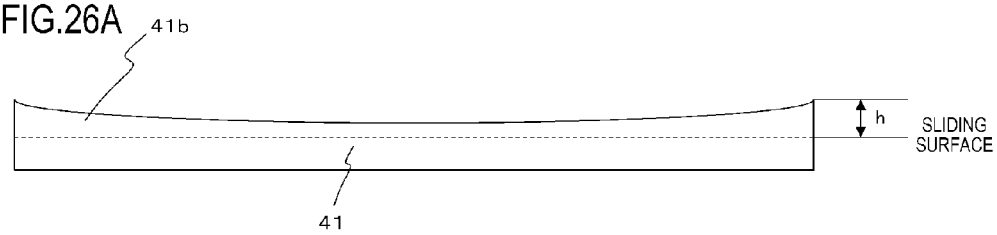
FIGS. 26A, 26B, and 26C are diagrams illustrating a comparison of the configuration between Embodiment 6 and Comparative Example 2.
Figure 26B:
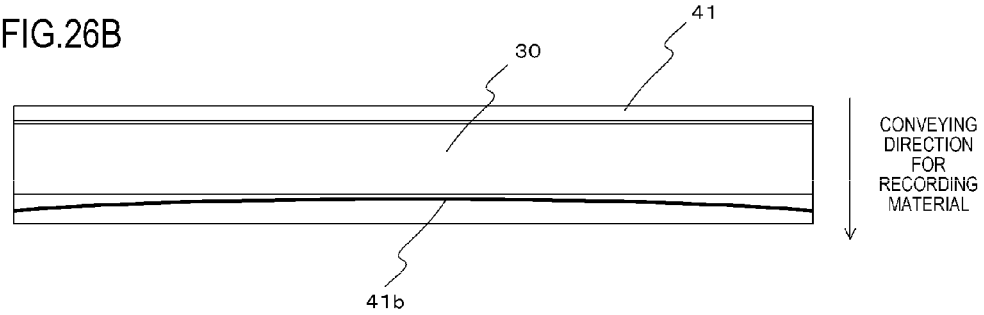
Figure 26C:
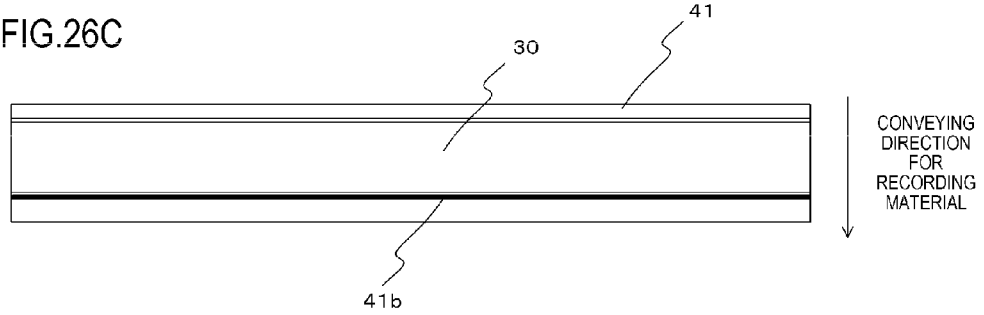

FIG. 25 is a diagram depicting the shape of the fixing nip N2 in Embodiment 6. As depicted in FIG. 25, the nip width of the fixing nip N2 is uniform in the longitudinal direction. The heater holding surface of the heater holder 41 is adjusted to be thicker at the central portion than at the opposite ends to provide the fixing nip N2 with a straight nip shape. Even with such a straight nip shape, when the protruding portion 41*b* is arranged straight in the longitudinal direction to allow the protruding distance h to vary in the longitudinal direction as in Comparative Example 2, the pressure peak formed by the protruding portion 41*b* varies in the longitudinal direction. In Embodiment 6, to suppress such a difference in the pressure peak, the protruding portion 41*b* is gently curved such that the ends are arranged on the downstream side of the central portion.

Figure 27A:
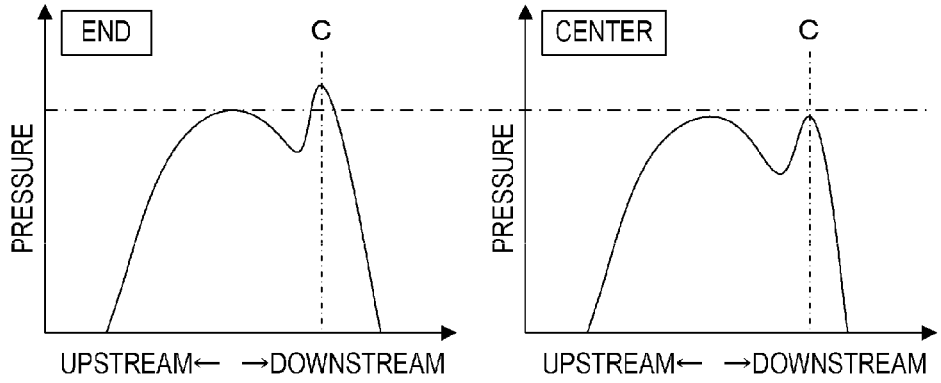
FIGS. 27A, 27B and 27C are graphs illustrating a pressure distribution in Embodiment 6 and a pressure distribution in Comparative Example 2.
Figure 27B:
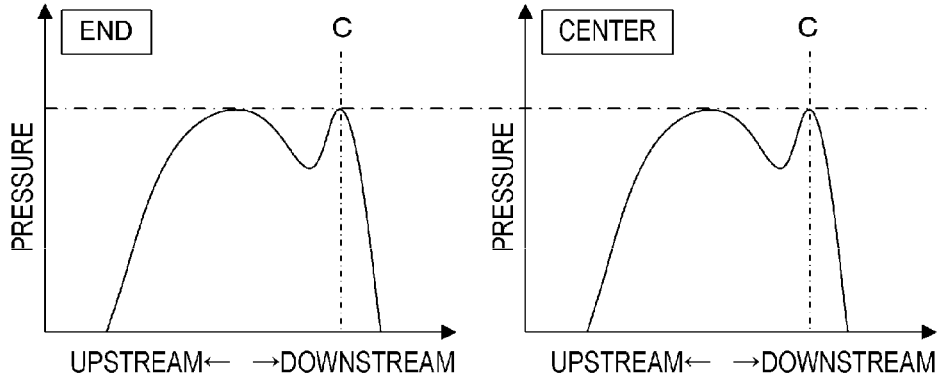
Figure 27C:
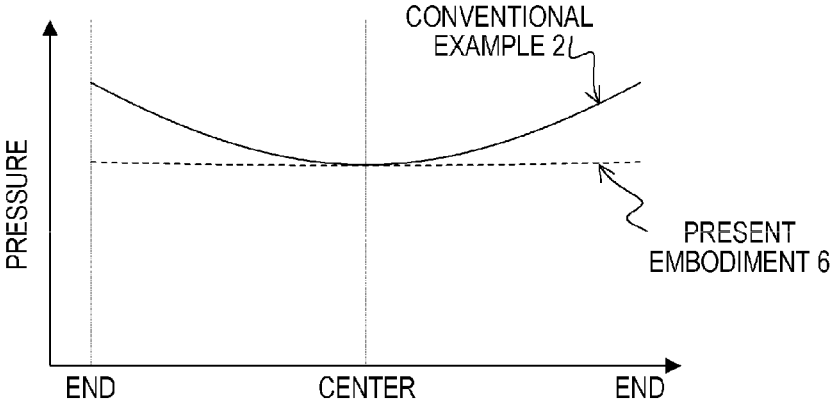

Specific effects of Embodiment 6 will be described in comparison with Comparative Example 2. FIGS. 27A, 27B and 27C are graphs illustrating a pressure distribution in Embodiment 6 and a pressure distribution in Comparative Example 2. FIG. 27A is a graph illustrating the pressure distribution in the fixing nip N2 in the conveying direction of the recording material P in Comparative Example 2. As illustrated in FIG. 27A, the pressure peak C is present on the downstream side both at the ends and at the central portion. The pressure peak is formed by the protruding portion 41*b* of the heater holder 41. At the ends, the protruding distance h of the protruding portion 41*b* is longer than at the central portion, leading to a higher penetration level of the protruding portion 41*b* into the pressuring roller 20 and thus a higher pressure peak than at the central portion.

On the other hand, FIG. 27B is a graph illustrating the pressure distribution in the fixing nip N2 in the conveying direction of the recording material P in Embodiment 6. In Embodiment 6, the ends of the protruding portion 41*b* are arranged on the downstream side of the central portion of the protruding portion 41*b*, enabling a reduction in the penetration level of the ends of the protruding portion 41*b* into the pressuring roller 20. Thus, as illustrated in FIG. 27B, the pressure peak can be formed to be lower than the pressure peak in Comparative Example 2.

FIG. 27C is a diagram illustrating the distribution of the pressure peak in the longitudinal direction in Embodiment 6 and in Comparative Example 2. The pressure peak in Comparative Example 2 increases gradually from the central portion to each end. Thus, in Comparative Example 2, the gloss value of the recording material is larger at the ends than at the central portion, leading to a variation in gloss value. In Embodiment 6, the pressure peak can be made substantially the same at the ends and at the central portion, allowing the pressure peak to be made uniform in the longitudinal direction. That is, Embodiment 6 allows the difference in the pressure peak in the longitudinal direction to be more appropriately suppressed than Comparative Example 2, providing images with no variation in gloss value all along the protruding portion 41*b* in the longitudinal direction.

Embodiment 6 also enables the pressure peak to be made substantially the same all along the protruding portion 41*b* in the longitudinal direction, allowing the wear of the portion of the release layer of the fixing film 10 that is rubbed by the edge of the recording material to be restrained compared to Comparative Example 2. In Embodiment 6 described above, even when the protruding distance h of the protruding portion 41*b* varies in the longitudinal direction, the curved shape of the protruding portion 41*b* serves to reduce the difference in the pressure peak in the longitudinal direction, enabling suppression of a variation in gloss value and a reduction in the wear amount of the release layer of the fixing film.

The shape of the protruding portion 41*b* is not limited to the curved shape. For example, the protruding portion 41*b* may be linearly arranged, and the central portion of the protruding portion 41*b* may be displaced toward the downstream side of the ends of the protruding portion 41*b*. Alternatively, the protruding portion 41*b* may be V-shaped such that the central portion is arranged on the downstream side of the ends.

In the description of Embodiment 6, the protruding distance h of the protruding portion 41*b* is longer at the ends than at the central portion. However, the present invention is applicable to a case where the protruding distance h of the protruding portion 41*b* is longer at the central portion than at the ends. When the protruding distance h is set longer at the central portion than at the ends, the recording material P having passed through the fixing nip N2 can be curved in the longitudinal direction and thus shaped to protrude toward the pressuring roller 20. As a result, the recording material P can be made rigid in the longitudinal direction so as to be difficult to bend in the conveying direction. In such a case, the central portion of the protruding portion 41*b* with the longer protruding distance is arranged on the downstream side of the ends of the protruding portion 41*b* to allow the pressure peak at the ends to be made substantially the same as the pressure peak at the central portion. Furthermore, the configuration in Embodiment 6 is applicable when the protruding portion 41*b* is arranged on the upstream side in the conveying direction of the recording material P. In this case, the pressure peak in the longitudinal direction can be made even by configuring the protruding portion 41*b* such that the ends are arranged on the downstream side of the central portion.

Embodiment 7

Now, with reference to FIGS. 28A, 28B, 28C, 29A, 29B, and 29C, Embodiment 7 in the present invention will be described. In the fixing apparatus used for the description of Embodiments 1 to 6, the heater 30 is used as a heater. However, the present invention is not limited to such a heating member. Regardless of a heating scheme, any other configuration may be used as long as the pressure peak is formed by the protruding portion. For example, the present invention is applicable to a film heating scheme using electromagnetic induction.

Figure 28A:
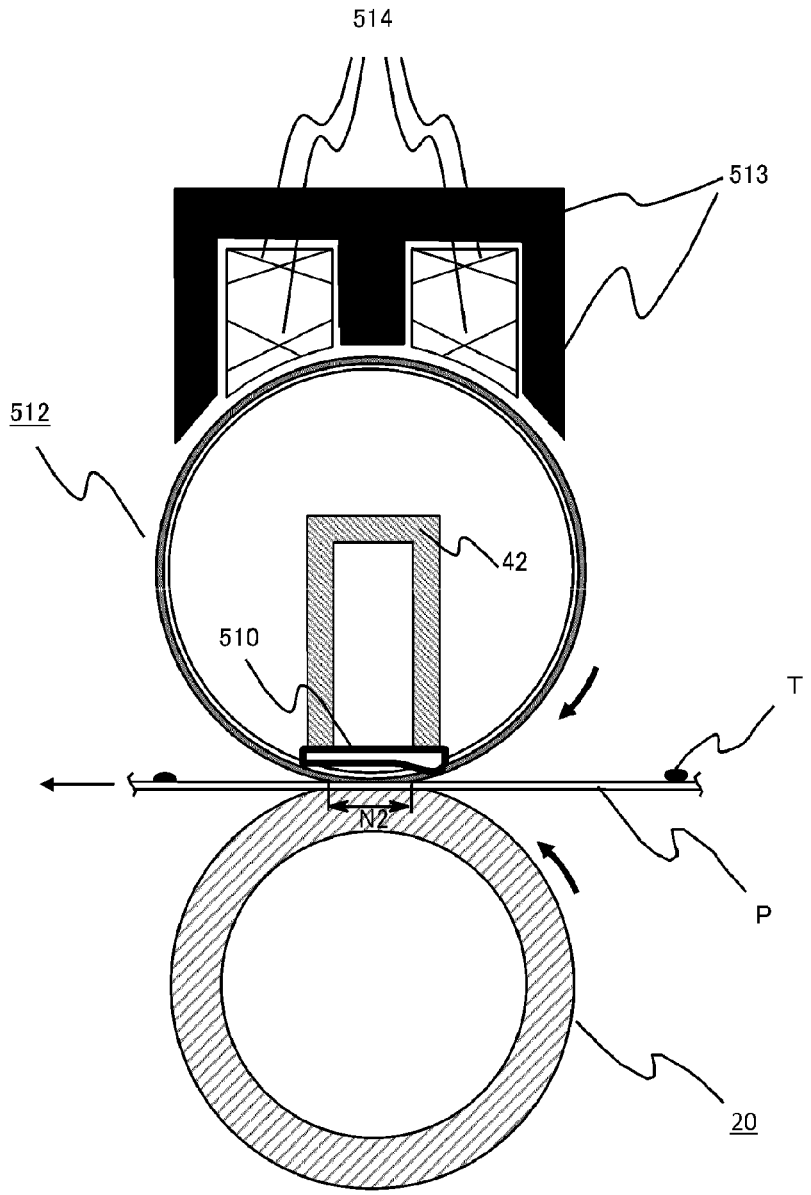
FIGS. 28A, 28B and 28C are diagrams illustrating Embodiment 7.
Figure 28B:
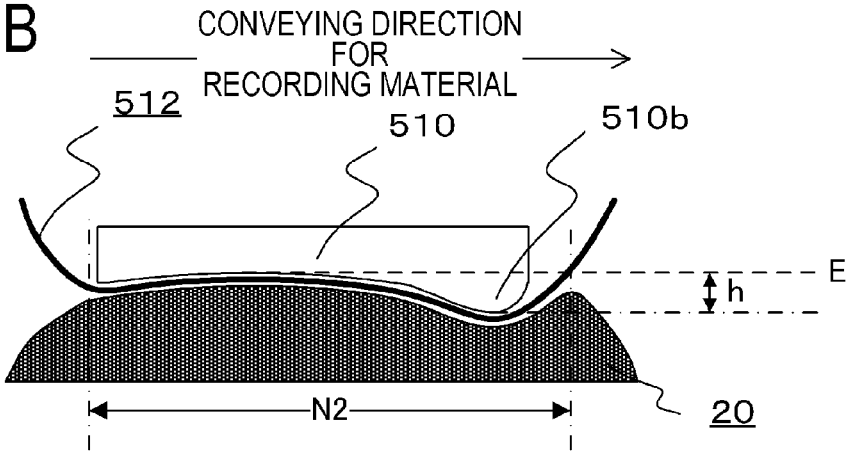
Figure 28C:
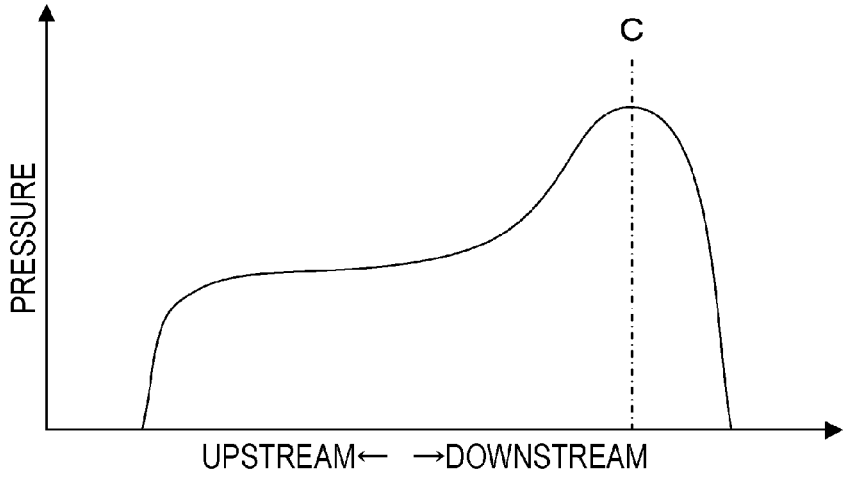

FIGS. 28A, 28B, and 28C are diagrams illustrating Embodiment 7. FIG. 28A is a schematic transverse sectional view of a fixing apparatus based on the film heating scheme using electromagnetic induction in Embodiment 7. FIG. 28B is an enlarged view of the nip in the fixing apparatus in Embodiment 7. FIG. 28C is a diagram illustrating the pressure distribution in the fixing nip N2 in the conveying direction of the recording material P in Embodiment 7. Components similar to those of Embodiment 1 will not be described below.

As depicted in FIG. 28A, the fixing apparatus in Embodiment 7 has a fixing film 512 as a cylindrical film member serving as an electromagnetic induction heating member and the pressuring roller 20 serving as a roller member that contacts the fixing film 512 under pressure. The fixing film 512 has a laminate configuration in which abase layer is a heating layer that generates heat under the effect of a magnetic field and an elastic layer and a release layer both provided around an outer periphery of the fixing film 512. A nip forming member 510 serving as a contact member is provided on an inner peripheral surface of the fixing film 512. The cylindrical fixing film 512 is loosely fitted over the nip forming member 510. The fixing apparatus also has magnetic field generating means including an excitation coil 514 and a magnetic core (core material) 513 and disposed outside the fixing film 512.

The pressuring roller 20 is rotationally driven, and the cylindrical fixing film 512 rotates outside the nip forming member 510 in conjunction with the rotational driving of the pressuring roller 20. Power is supplied to the excitation coil 514 to cause the fixing film 512 to generate heat under the effect of electromagnetic induction. Subsequently, a recording material P with an unfixed toner image T formed thereon is introduced into the fixing nip N2 with an image surface of the recording material P facing upward, that is, with the image surface facing the fixing film surface. The recording material P is then conveyed while being sandwiched with the image surface in close contact with the outer surface of the fixing film 512. During this process, the fixing film 512 generate heat under the effect of electromagnetic induction to heat and fix the unfixed toner image T to the recording material P. Upon passing through the fixing nip N2, the recording material P is separated from an outer surface of the fixing film 512 and discharged and conveyed.

As depicted in FIG. 28B, the nip forming member 510 in Embodiment 7 has a protruding portion 510*b* provided, in the longitudinal direction, along a portion of the nip forming member 510 that contacts an inner peripheral surface of the fixing film 512 on the downstream side of the fixing nip N2 in the conveying direction of the recording material P. The protruding portion 510*b* protrudes the protruding distance h from a very small portion E of a pressure contact plane between the nip forming member 510 and the fixing film 512 toward the outside of the fixing film 512.

In contrast to Embodiments 1 to 6, the nip forming member 510 is not a plate-like heater and can thus be freely shaped. Consequently, a surface of the nip forming member 510 that contacts the inner surface of the fixing film 512 under pressure may be a curved surface. Therefore, the pressure distribution in the conveying direction of the recording material P formed by the fixing nip N2 may be a distribution in which the pressure gradually increases toward the downstream side as depicted in FIG. 28C instead of a pressure distribution with two peaks as illustrated in Embodiments 1 to 6.

Figure 29A:
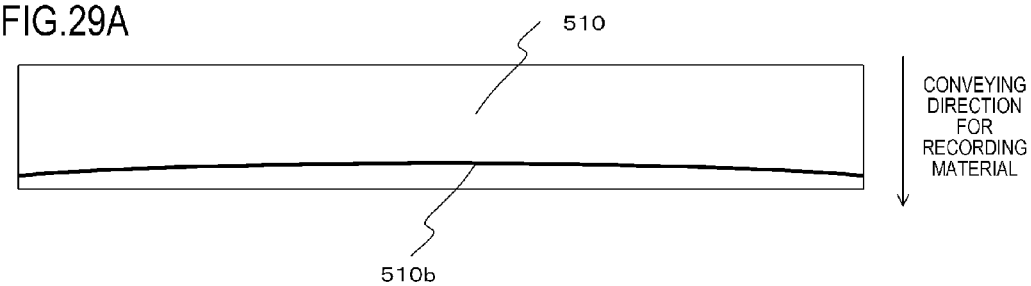
FIGS. 29A, 29B, and 29C are diagrams depicting a nip forming member in Embodiment 7.
Figure 29B:
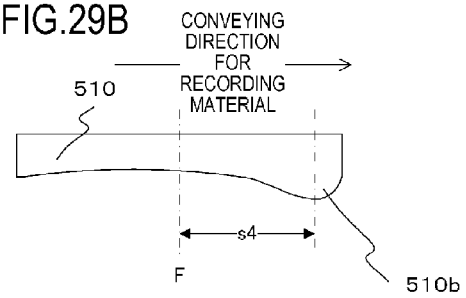
Figure 29C:
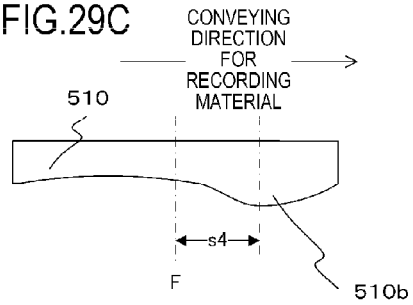

FIGS. 29A, 29B, and 29C are diagrams depicting the nip forming member in Embodiment 7. FIG. 29A is a diagram of the nip forming member 510 in Embodiment 7 as viewed from a nip forming surface. The protruding portion 510*b* in Embodiment 7 is gently curved such that ends thereof are arranged on the downstream side of a central portion thereof in the conveying direction of the recording material. FIGS. 29B and 29C are sectional views of the nip forming member 510 depicting the positional relations of the protruding portion 510*b* at the ends and at the central portion in the longitudinal direction. In Embodiment 7, the position of the protruding portion 510*b* is defined based on a distance from a center F of the fixing nip N2. However, the present invention is not limited to this method. Specifically, the protruding portion 510*b* is arranged such that a distance s4 involves a relation "central portion<ends".

In the configuration in Embodiment 7, the ends of the protruding portion 510*b* are arranged on the downstream side of the central portion of the protruding portion 510*b* because the nip width of the fixing nip N2 is larger at the ends than at the central portion. This arrangement of the protruding portion 510*b* allows the penetration level of the protruding portion 510*b* into the pressuring roller 20 to be made substantially the same all along the protruding portion 41*b* in the longitudinal direction. As a result, the pressure peak formed by the protruding portion 510*b* can be made substantially the same all along the protruding portion 510*b* in the longitudinal direction. Therefore, images can be obtained which are prevented from having a variation in gloss value all along the protruding portion 510*b* in the longitudinal direction.

The resultant uniform pressure peak allows suppression of uneven wear of the release layer of the fixing film 10 in the longitudinal direction. The shape of the protruding portion 510*b* is not limited to the curved shape. For example, the protruding portion 510*b* may be shaped like the protruding portion described in Embodiment 1 or Embodiment 2. Furthermore, effects similar to those of Embodiments 4 to 6 may be produced by applying the invention described in Embodiments 4 to 6 to the film heating scheme using electromagnetic induction.

Embodiment 8

Figure 30:
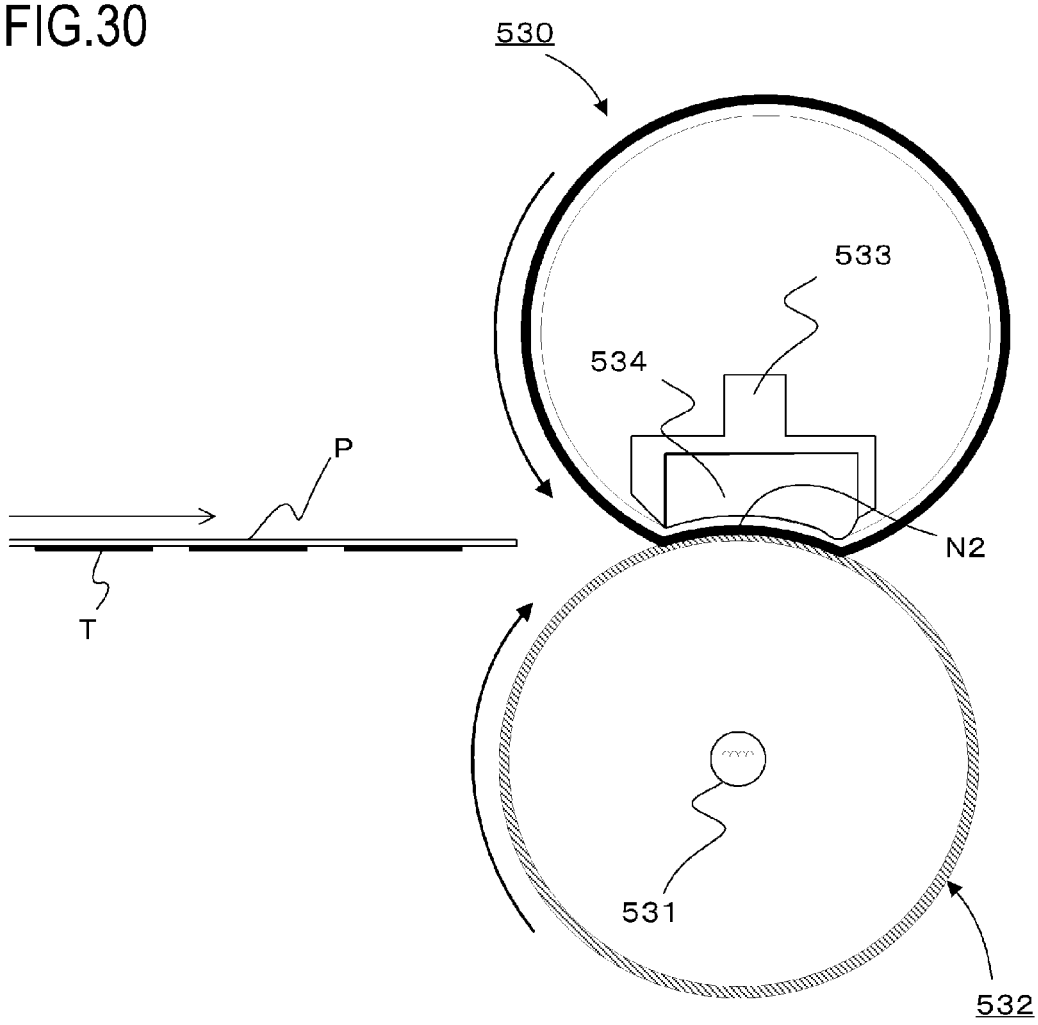
FIG. 30 is a schematic diagram of a pressure film-based fixing apparatus in Embodiment 8.

Now, with reference to FIG. 30, Embodiment 8 of the present invention will be described. The present invention is applicable to a pressuring film-based fixing apparatus. FIG. 30 is a schematic diagram of a pressuring film-based fixing apparatus in Embodiment 8. The pressuring film-based fixing apparatus will be described using FIG. 30. Components similar to those of Embodiment 1 will not be described below.

The fixing apparatus in Embodiment 8 internally includes a heating member 531 such as a halogen heater and has a fixing roll 532 supported so as to be rotatable around a central axis of the heating member 531 and serving as a roller member. The fixing apparatus also has a pressuring member 530 supported parallel to the axis of the fixing roll 532 and contacted by the fixing roll 532 under pressure; the pressuring member 530 serves as a film member. The pressuring member 530 has a nip forming member 534 provided on an inner peripheral surface of the pressuring member 530 and serving as a contact member. The nip forming member 534 is supported by a support member 533 and has a protruding portion on the downstream side in the conveying direction of the recording material P. The nip forming member 534 is curved so as to conform to the shape of a peripheral surface of the fixing roll 532. The present invention can be applied to such a pressuring film-based fixing apparatus that performs pressuring from a non-printed surface side to form a fixing nip shaped like a curved surface conforming to the shape of the peripheral surface of the fixing roll 532, to produce effects similar to those of Embodiments 1 to 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing apparatus that fixes an image on a recording material, the fixing apparatus comprising:

a tubular film;

a nip forming member that contacts an inner surface of the film; and a roller that forms a nip portion together with the nip forming member via the film, wherein the nip portion is an area where the film and the roller are in contact with each other and where the recording material is conveyed, wherein the nip forming member has a protruding portion, protruding toward the roller and extending in a generatrix direction of the film, that is provided on a downstream side in the nip portion in a conveying direction of the recording material, wherein in the conveying direction of the recording material, an end portion of the protruding portion in the generatrix direction is arranged at a location different from a central portion of the protruding portion in the generatrix direction, and wherein the nip forming member includes a nip member and a support member that supports the nip member, and the protruding portion is disposed in an area of the support member that is located on a downstream side of the nip member in the conveying direction, and the protruding portion protrudes in a direction in which the protruding portion is closer to the roller than a surface of the nip member that contacts the inner surface of the film.

2. The apparatus according to claim 1, wherein the protruding portion is formed so as to form a pressure peak in the nip portion in the conveying direction.

3. The apparatus according to claim 1, wherein a protruding amount of the end portion of the protruding portion is shorter than that of the central portion of the protruding portion.

4. The apparatus according to claim 1, wherein the nip member is a heater.

5. The apparatus according to claim 1, wherein the end portion of the protruding portion is arranged at a location downstream of the central portion of the protruding portion in the conveying direction.

* * * * *